US006262005B1

(12) United States Patent
Willey et al.

(10) Patent No.: US 6,262,005 B1
(45) **Date of Patent: *Jul. 17, 2001**

(54) PHOTOBLEACHING COMPOSITIONS EFFECTIVE ON DINGY FABRIC

(75) Inventors: Alan David Willey, Cincinnati, OH (US); Brian Jeffreys, Grimbergen; David William Ingram, Woluwe Saint-Lambergt, both of (BE); James Charles Theophile Roger Burckett-St. Laurent, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/355,152

(22) Filed: Jul. 23, 1999

Related U.S. Application Data

(60) Provisional application No. 60/035,842, filed on Jan. 24, 1997.

(51) Int. Cl.[7] ..... C11D 7/54
(52) U.S. Cl. ..... 510/301
(58) Field of Search ..... 510/301

(56) References Cited

U.S. PATENT DOCUMENTS

| | | | | |
|---|---|---|---|---|
| 3,094,536 | | 6/1963 | Kenney et al. | 260/314.5 |
| 3,927,967 | | 12/1975 | Speakman | 8/103 |
| 4,033,718 | | 7/1977 | Holcombe et al. | 8/103 |
| 4,166,718 | | 9/1979 | Reinert et al. | 8/111 |
| 4,240,920 | | 12/1980 | de Luque | 252/99 |
| 4,255,273 | | 3/1981 | Sakkab | 252/102 |
| 4,256,597 | | 3/1981 | Sakkab | 252/99 |
| 4,318,883 | | 3/1982 | Polony et al. | 422/22 |
| 4,368,053 | | 1/1983 | Eckhardt et al. | 8/102 |
| 4,497,741 | | 2/1985 | Hölzle et al. | 260/245.77 |
| 4,648,992 | | 3/1987 | Graf et al. | 540/124 |
| 5,679,661 | * | 10/1997 | Willey | 514/63 |
| 5,916,481 | * | 6/1999 | Willey | 252/186.21 |

FOREIGN PATENT DOCUMENTS

| | | | |
|---|---|---|---|
| 0285965 | 10/1988 | (EP) | C09B/67/22 |
| 0381211 | 8/1990 | (EP) | G11B/7/24 |
| 0484027 | 5/1992 | (EP) | C09B/47/04 |
| 1372035 | 10/1974 | (GB) | D06L/03/04 |
| 1408144 | 1/1975 | (GB) | D06L/03/04 |
| 2159516 | 12/1985 | (GB) | C09B/47/04 |
| 6-73397 | 3/1994 | (JP) | C11D/3/395 |
| WO 91/18006 | 11/1991 | (WO) | C07J/43/00 |

OTHER PUBLICATIONS

Brasseur, N., et al., "Synthesis and Photodynamic Activities of Silicon 2,3–Naphthalocyanine Derivatives", J. Med. Chem., vol. 37, p. 415–420 (1994).

Cook, M.J. et al., "Octa–alkoxy Phthalocyanine and Naphthalocyanine Dertivatives: Dyes with Q band Absorption in the Far Red or Near Infrared" J. Chem. Soc., Perkin Trans., vol. I., pp. 2453–2458 (1988).

Esposito, J.N. et al., "The Synthesis and Physical Properties of Some Organo– and Organosiloxysilicon Phthalocyanines", Inorg. Chem., vol. 5, No. 11, pp. 1979–1984 (Nov. 1966).

Ford, W.E. et al., "Synthesis and Photochemical Properties of Aluminum, Gallium, Silicon, and Tin Naphthalocyanines", Inorg. Chem., vol. 31, p. 3371–3377 (1992).

Hayashida, S., et al., "Effect of Axial Substituents on the Aggregate of Silicon Naphthalocyanine in the Vacuum Deposited Thin Films", Chem. Lett., pp. 2137–2140 (1990).

Joyner, R.D. et al, "Phthalocyaninosilicon Compounds", Inorg. Chem., vol. 1, No. 2, pp. 236–238 (May 1962).

Kroenke, W.E. et al., "The Infrared Spectra of Some Tin and Lead Phthalocyanines", Inorg. Chem., vol. 3, No. 5, pp. 696–698 (May 1964).

Lowery, M.H. et al., "Dichloro(phthalocyanino)silicon", Inorg. Chem., vol. 4, p. 128 (1965).

Moyer, T. J., et al., "Iodine Doped $(SiNcO)_n$—A new Conducting Polymer", Polymer Preps, vol. 25, p. 234–235 (1986).

Rafaeloff, R., et al., "New Group IV Phthalocyanines", J. Inorg. Nucl. Chem., vol. 28, pp. 899–902 (1966).

Wen, T–C., et al., "Synthesis and Photoproperties of Silicon Phthalocyanines and Silicon Naphthalocyanines", J. Chin. Chem. Soc., vol. 40, pp. 141–147 (1993).

Wheeler, B.L. et al., "A Silicon Phthalocyanine and a Silicon Naphthalocyanine; Synthesis, Electrochemistry, and Electrogenerated Chemiluminescence" J. Am. Chem. Soc., vol. 106, p. 7404–7410 (1984).

Witkiewic, Z. et al., "Properties of Octamethoxyphthalocyanines I. On their syntheses, electrical conductivity, and catalytic activity", Material Science, vol. 11, No. 1–2, pp. 39–45 (1976).

* cited by examiner

*Primary Examiner*—John Hardee
(74) *Attorney, Agent, or Firm*—Fay, Sharpe, Fagan, Minnich & McKee, LLP

(57) ABSTRACT

Photosensitizing compounds suitable for use as laundry detergent photobleaches are disclosed. The disclosed compounds are phthalocyanine and naphthalocyanines comprising axial moieties selected for their hydrophobic character as measured by their ClogP. Also disclosed are methods for bleaching fabrics and methods for disinfecting hard surfaces.

28 Claims, No Drawings

PHOTOBLEACHING COMPOSITIONS EFFECTIVE ON DINGY FABRIC

This application claims the benefit of the filing date of U.S. Provisional Application No. 60/035,842 filed Jan. 24, 1997.

FIELD OF THE INVENTION

The present invention relates to compositions containing metallocyanine photobleaching compounds having axial groups which enhance the effectiveness of the photobleaching compounds against hydrophobic, or "dingy", stains. The invention also relates to novel metallocyanine photobleaching compounds and to a method of delivering compositions comprising said photobleaches to soiled articles.

BACKGROUND OF THE INVENTION

Dingy soils and stains are a common problem on articles of clothing. The composition of "dingy" stains can vary. Some fabrics may have limited areas of "dingy" stain (armpits, elbows) while others appear "dingy" in their entirety. Typically, laundry detergent compositions are not effective in removing this dingy soils and stains from fabric.

It has now surprisingly been found that certain metallocyanine compounds are effective against "dingy" soils or stains. For the purposes of the present invention the term "dingy" soils or stains refers to dirt, oils, grime, soil, or other staining material that accumulate on fabric and are not effectively removed by the action of detersive surfactants.

It is known that certain water-soluble phthalocyanine and naphthalocyanine compounds, optionally complexed with certain metals, have a singlet oxygen generation action and can therefore be used as photo-bleaching agents or antimicrobial active agents.

"Singlet oxygen" is an oxidative species capable of reacting with stains to chemically bleach them to a colorless and usually water-soluble state, a process called photochemical bleaching. Common photochemical bleaches include zinc and aluminum phthalocyanines.

The prior art teaches phthalocyanine and naphthalocyanine compounds having the general structure

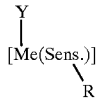

where Me is a transition or non-transition metal, (Sens.) is a phthalocyanine or naphthalocyanine ring which, when combined with a suitable Me unit, is capable of undergoing photosensitization of oxygen molecules, R represents one or more substituent groups which are bonded to the photosensitization ring units (Sens.) to enhance the solubility or photochemical properties of the molecule, and Y represents one or more substituents associated with the metal atom, for example, anions to provide neutrality. The selection of particular substituents R for substitution into the molecule has been the focus of many years of research.

A major limitation of phthalocyanine and naphthalocyanine as compounds for fabric photobleaching is that these molecules are highly colored as the Q-band, the main absorption band, is in the range of visible light. As a consequence of their high color, photobleaches can stain or hue fabrics.

A second limitation arises from the fact that many phthalocyanine and naphthalocyanine compounds including their transition or non-transition metal complexes are not inherently water soluble. This is especially true in the case of naphthalocyanines. It has therefore been the task of photobleach formulators to identify R substituents that increase the molecule's water solubility without adversely affecting its photochemical effectiveness.

A further task for formulators of photobleaches has been the need to modify the properties of the phthalocyanines and naphthalocyanines to improve their photobleaching capacity (photophysics), which includes increasing the quantum efficiency. Selection of suitable R units to accomplish this task must not in turn adversely affect the water solubility. While balancing water solubility and enhanced photophysics, the formulator must insure that the structural modifications do no shift the $\lambda_{max}$ of the Q-band to a wavelength that increase the color of the photobleach.

The present invention allows the formulator to modify solubility, photoefficiency, Q-band wavelength maxima and the electronic requirements of the central metal atom independently. This ability to delineate and selectively modify the key structural elements contributing to the properties of the photobleach provides the formulator with greater flexibility in obtaining the desirable properties described above.

It has now been surprisingly discovered that by manipulation of one or more axial substituents, hereinafter axial R units which are nonionic and axial T units which are anionic, photobleaching compositions can be produced which are effective in removing the "dingy" stain from soiled fabric. The R axial moiety is selected for its ability to allow the photobleaching compound to partition into the layer of "dingy" soiling material where it then acts to photobleach the material.

It is an object of the present invention to provide photobleaching compounds which can effectively remove or bleach dingy soils on fabric or hard surfaces.

It is a further object of the present invention to provide photobleaching compositions for non-aqueous and low aqueous application, that is, photobleaching compositions for use with cleaning solutions wherein water constitutes less than half of the carrier liquid.

It is a further object of the present invention to provide photobleaching compositions and cleaning compositions comprising substantive materials for non-porous hard surfaces, inter alia, Formica®, ceramic tile, glass, or for porous hard surfaces such as concrete or wood.

An object of the present invention is to provide a method for bleaching fabric with laundry compositions comprising metallocyanine photosensitizing compounds of the present invention.

An object of the present invention is to provide for low hue metallocyanine photosensitizing compounds having a Q-band maximum absorption wavelength of at least 660 nanometers.

BACKGROUND ART

Various patent documents relate to photochemical bleaching or to the use of phthalocyanine and naphthalocyanine compounds as well as their formulation and synthesis. See for example U.S. Pat. No. 3,094,536 issued Jun. 18, 1963; U.S. Pat. No. 3,927,967 issued Dec. 23, 1975; U.S. Pat. No. 4,033,718 issued Jul. 5, 1977; U.S. Pat. No. 4,166,718 issued Sep. 4, 1979; U.S. Pat. No. 4,240,920 issued Dec. 23, 1980; U.S. Pat. No. 4,255,273 issued Mar. 10, 1981; U.S. Pat. No. 4,256,597 issued Mar. 17, 1981; U.S. Pat. No. 4,318,883 issued Mar. 9, 1982; U.S. Pat. No. 4,368,053 issued Jan. 11, 1983; U.S. Pat. No. 4,497,741 issued Feb. 5, 1985; U.S. Pat. No. 4,648,992 issued Mar. 10, 1987; and U.K. Pat. App. 1,372,035 published Oct. 30, 1974; U.K Pat. App. 1,408,144 published Oct. 1, 1975; U.K. Pat App. 2,159,516 published Dec. 4, 1985; E.P. 285,965 A2; E.P. 381,211 A2 published Aug. 8, 1990; E.P. 484,027 A1 published May 6, 1992; WO 91/18006 published Nov. 28, 1991 and Japanese Kokai 06-73397 Derwent Abst. No. (94-128933) published Mar. 15, 1994.

In addition to the above cited patent publications, other references describing the synthesis, preparation and properties of phthalocyanines and naphthalocyanines, incorporated herein also by reference; *Phthalocyanines: Properties and Applications*, Leznoff, C. C. and Lever A. B. P. (Eds), VCH, 1989; *Infrared Absorbing Dyes,* Matsuoka, M. (Ed), Plenum, 1990; *Inorg. Chem.,* Lowery, M. J. et al., 4, pg. 128, (1965); *Inorg. Chem.* Joyner R. D. et al., 1, pg. 236, (1962); *Inorg. Chem.*, Kroenke, W. E. et al., 3, 696, 1964; *Inorg. Chem.* Esposito, J. N. et al., 5, pg.1979, (1966); *J. Am. Chem. Soc. Wheeler, B. L. et al.,* 106, pg. 7404, (1984); *Inorg. Chem.* Ford, W. E, et al., 31, pg. 3371, (1992); *Material Science*, Witkiewicz, Z. et al., 11, pg. 39, (1978); *J. Chem. Soc.* Perkin Trans. I, Cook, M. J., et al., pg. 2453, (1988); *J. Chin. Chem. Soc.,* 40, pg. 141, (1993); *J. Inorg. Nucl. Chem.,* 28, pg. 899, (1966); *Polymer Preps,* 25, pg. 234, (1986); *Chem. Lett.,* 2137, (1990); *J. Med. Chem.,* 37, pg. 415, (1994).

SUMMARY OF THE INVENTION

The present invention relates to laundry detergent compositions comprising:

a) at least about 0.001 ppm, preferably from about 0.01 to about 10000 ppm, more preferably from about 0.1 to about 5000 ppm, most preferably form about 10 to about 1000 ppm, of a metallocyanine photobleach compound selected from substituted or unsubstituted phthalocyanines and naphthalocyanines complexed with a photoactive metal selected from the group consisting of silicon, germanium, tin, lead, aluminum, platinum, palladium, phosphorous and mixtures thereof; and wherein further said photoactive metal is bonded to at least one nonionic moiety having a ClogP value greater than 1;

b) at least about 0.1%, preferably from about 0.1% to about 95%, more preferably from about 0.1% to about 30% by weight, of a detersive surfactant; and c) the balance carriers and adjunct materials.

The present invention also relates to metallocyanine photobleaches suitable for use in the photobleaching compositions described herein.

All percentages, ratios and proportions herein are by weight, unless otherwise specified. All temperatures are in degrees Celsius (° C.) unless otherwise specified. All documents cited are in relevant part, incorporated herein by reference.

DETAILED DESCRIPTION OF THE INVENTION

Laundry detergent compositions according to the present invention effective against dingy soils or stains comprise:

a) at least about 0.001 ppm, preferably from about 0.01 to about 10000 ppm, more preferably from about 0.1 to about 5000 ppm, most preferably form about 10 to about 1000 ppm, of a photobleach according to the present invention;

b) at least about 0.1%, preferably from about 0.1% to about 95%, more preferably from about 0.1% to about 30% by weight, of a detersive surfactant; and c) the balance carriers and adjunct materials.

Preferred laundry detergent compositions according to the present invention effective against dingy soils or stains comprise:

a) at least about 0.1% by weight, of a detersive surfactant selected from the group consisting of anionic, nonionic, cationic, zwitterionic, ampholytic surfactants, and mixtures thereof;

b) at least about 0.001 ppm, preferably from about 0.01 to about 10000 ppm, more preferably from about 0.1 to about 5000 ppm, most preferably form about 10 to about 1000 ppm, of a photobleach according to the present invention;

c) at least about 0.01% by weight, of a soil release agent; and d) carriers and adjunct ingredients.

Further preferred laundry detergent compositions according to the present invention effective against dingy soils or stains comprise:

a) at least about 0.1% by weight, of a detersive surfactant selected from the group consisting of anionic, nonionic, cationic, zwitterionic, ampholytic surfactants, and mixtures thereof;

b) at least about 0.001 ppm, preferably from about 0.01 to about 10000 ppm, more preferably from about 0.1 to about 5000 ppm, most preferably form about 10 to about 1000 ppm, of a photobleach according to the present invention;

c) at least about 0.01% by weight, of a non-halogen bleach; and d) carriers and adjunct ingredients.

Substituted aryl units are defined as moieties having the formula:

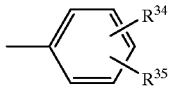

wherein $R^{34}$ and $R^{35}$ are independently selected from the group consisting of hydrogen, $C_1$–$C_6$ alkyl, $C_3$–$C_6$ alkenyl, $C_1$–$C_6$ alkoxy, $C_3$–$C_6$ branched alkoxy, halogen, morpholino, cyano, nitrilo, $—CO_2^-M^+$, $—SO_3^-M^+$, $—OSO_3^-M^+$, $—N(R^{36})_2$, and $—N^+(R^{36})_3X^-$ wherein each $R^{36}$ is independently hydrogen or $C_1$–$C_4$ alkyl; and mixtures thereof; wherein M is a water soluble cation and X is chlorine, bromine, iodine, or other water soluble anion. Examples of other water soluble anions include organic species such as fumarate, tartrate, oxalate and the like, inorganic species include sulfate, hydrogen sulfate, phosphate and the like. When both $R^{34}$ and $R^{35}$ comprise hydrogen the unit is defined as "unsubstituted".

Alkylenearyl units are defined as moieties having the formula:

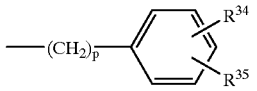

wherein $R^{34}$ and $R^{35}$ are the same as define above, p is from 1 to about 10.

Aryloxy units are defined as moieties having the formula:

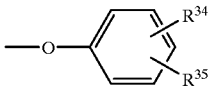

wherein $R^{34}$ and $R^{35}$ are the same as define above.

Alkyleneoxyaryl units are defined as moieties having the formula:

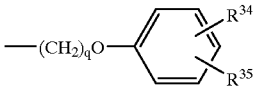

wherein $R^{34}$ and $R^{35}$ are the same as define above, q is from 0 to about 10.

Oxyalkylenearyl units are defined as moieties having the formula:

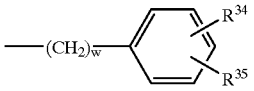

wherein $R^{34}$ and $R^{35}$ are the same as define above, w is from 1 to about 10.

Branched alkoxy units are defined as moieties having the formula

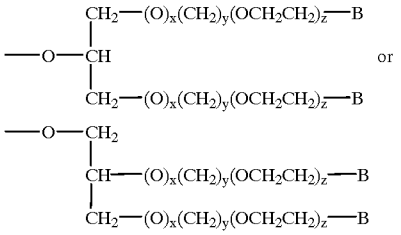

wherein B is hydrogen, hydroxyl, $C_1$–$C_{30}$ alkyl, $C_1$–$C_{30}$ alkoxy, —$CO_2H$, $OCH_2CO_2H$, —$SO_3^-M^+$, —$OSO_3^-M^+$, —$PO_3^{2-}M$, —$OPO_3^{2-}M$, and mixtures thereof; preferably $C_1$–$C_{18}$ alkyl, —$CO_2H$, —$OCH_2CO_2H$, —$SO_3^-M^+$, —$OSO_3^-M^+$, —$PO_3^{2-}M$, —$OPO_3^{2-}M$, more preferably —$SO_3^-M^+$ or —$OSO_3^-M^+$; M is a water soluble cation in sufficient amount to satisfy charge balance; x is 0 or 1, each y independently has the value from 0 to 6, each z independently has the value from 0 to 100.

Substituted and un-substituted aryl, alkylenearyl, aryloxy, oxyalkylenearyl and alkyleneoxyaryl have the indices p, q, and w as defined herein above, and aryl can be any aromatic moiety substituted or unsubstituted including heterocycles, for example, phenyl, naphthyl, thienyl, pyridinyl, etc.

Alkylethyleneoxy units are defined as moieties having the formula:

$$—(O)_k—(CH_2)_m(OCH_2CH_2)_nOZ$$

wherein the index k is 0 or 1, Z is hydrogen, $C_1$–$C_{22}$ alkyl, $C_4$–$C_{22}$ branched alkyl, $C_3$–$C_{22}$ alkenyl, $C_4$–$C_{22}$ branched alkenyl, —$SO_3^-M^+$, and mixtures thereof, preferably hydrogen or $C_1$–$C_6$ alkyl, more preferably methyl; n is from 1 to 100, preferably from 0 to about 20, more preferably from 3 to about 10; and m is from 0 to 12, preferably from about 0 to about 5. However, no peroxide —O—O— bonds are contained within the photobleaching compounds of the present invention.

Alkyleneamino units are defined as moieties having the formula:

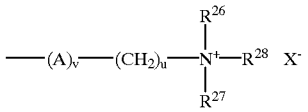

wherein $R^{26}$, and $R^{27}$ are each a $C_1$–$C_{22}$ alkyl, $C_4$–$C_{22}$ branched alkyl, $C_3$–$C_{22}$ alkenyl, $C_4$–$C_{22}$ branched alkenyl, $R^{28}$ is hydrogen, $C_1$–$C_{22}$ alkyl, $C_4$–$C_{22}$ branched alkyl, $C_3$–$C_{22}$ alkenyl, $C_4$–$C_{22}$ branched alkenyl and mixtures thereof, A is the heteroatom nitrogen or oxygen, preferably A is oxygen, the index v is 0 when the heteroatom is absent, v is equal to 1 when the heteroatom is present, X is chloride, bromide, iodide, or other water soluble anion, u is from 1 to 22. Examples of other water soluble anions include organic species such as fumarate, tartrate, oxalate and the like, inorganic species include sulfate, hydrogen sulfate, phosphate and the like.

Photobleaching Compounds

The photosensitizing compounds of the present invention which are effective in removing dingy soils or stains are substituted or unsubstituted phthalocyanines having the formula

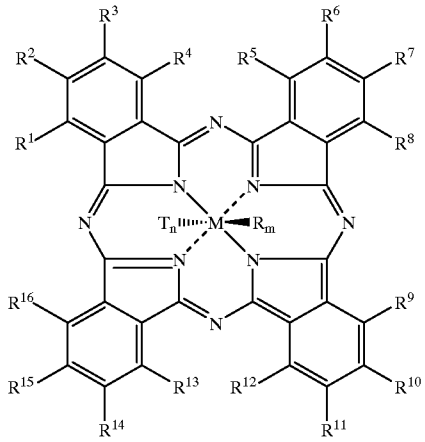

or substituted or unsubstituted naphthalocyanine having the formula:

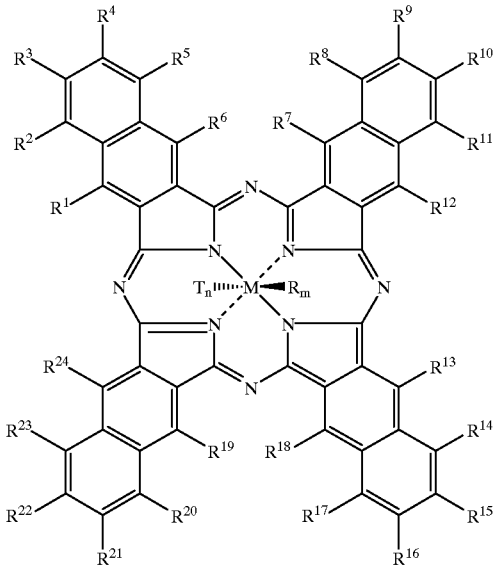

In the above formulas M is a photoactive metal or non-metal, preferably a photoactive metal or non-metal selected from the group consisting of silicon, germanium, tin, lead, aluminum, platinum, palladium, phosphorous, and mixtures thereof; that is M can not be para-magnetic. R units are axial hydrophobic moieties whose selection is based on the ClogP value of its conjugate HR form as described herein below. T units are anionically charged moieties as further described herein below. When two R units are present the T unit is absent. For metals or non-metals M having a valence of $3^+$ only an R unit is present. The index m has the value 1 or 2, the index n has the value 0 or 1; provided that when n is equal to 1, m is equal to 1 and when m is equal to 2, n is equal to 0.

Determining the HR Form of Axial R Units

A ligand, moiety, substituent, or unit which is attached at the axial position of the metallocyanines of the present invention for the purposes of mediating the solubility or substantivity of the photobleach towards dingy stain material is, for the purposes of the present invention, an "axial R unit". A substituent which is a candidate for use as an axial R unit can be evaluated for its suitability by taking the ligand, moiety, substituent, or unit in its uncombined HR form and evaluating the material by the procedure described herein below. The HR form of an axial R unit is defined as a moiety where a hydrogen atom takes the place of the metallocyanine. By way of illustration and not by way of limitation, if a phenyl moiety is chosen for R, then the HR form would be benzene and benzene would be evaluated in the method described below for the purpose of determining the suitability of phenyl as an axial R unit. A further example includes the selection of an oxyethyleneoxyalkyl moiety having the formula $$—O(CH_2CH_2O)_7(CH_2)_1CH_3$$

for use as an axial R unit. For the purposes of determining the ClogP value, as described herein below, the conjugate HR form having the formula $$H—O(CH_2CH_2O)_7(CH_2)_{11}CH_3$$

would be evaluated for suitability.

However, a material such as the ethyleneoxy alcohol above may be used to determine the suitability of this moiety attached in a different manner. For example, the axial R unit may have the formula $$HO(CH_2CH_2O)_7(CH_2)_{11}CH_2—$$

or the formula $$HO(CH_2CH_2O)_7(CH_2)_5\underset{|}{C}H(CH_2)_5CH_3$$

both variations of the same moiety and both of which have the conjugate HR form having the formula:

$$H—O(CH_2CH_2O)_7(CH_2)_{11}CH_3$$

for the purposes of determining the ClogP value and hence the suitability of these groups or use as axial R units.

A second example, phenol (hydroxybenzene) may be attached to the central metal atom via a covalent bond to the aryl portion of the molecule in a manner represented by three different geometric orientations relative to the —OH moiety; namely, ortho, meta, or para, having the formulas:

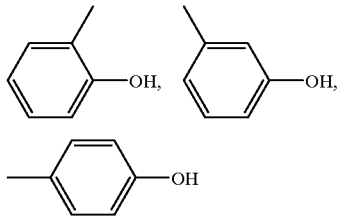

respectively. In addition to these three forms, this substituent may be bonded to the metallocyanine metal ring atom via the phenol oxygen atom to form a metal-oxygen ether linkage. However, all four of these axial R unit candidates (ortho, meta, para, and ether bonded) use hydroxybenzene (phenol) as the conjugate HR form for determining the ClogP value.

Determination of ClogP

The axial R units of the present invention are characterized by the calculated logarithm of their octanol/water partition coefficient, ClogP, of their conjugate HR form. The ClogP of the HR form of the axial R unit as described above is used to determine the suitability of a moiety for use as an axial R unit. The octanol/water partition coefficient of a selected HR species is the ratio between its equilibrium concentration in octanol and in water. Since the partition coefficients are frequently large, they are more conveniently given in the form of their logarithm to the base 10, logP.

The logP of many HR species has been reported; for example, the Ponmona92 database, available from Daylight Chemical Information Systems, Inc.(Daylight CIS), contains many, along with citations to the original literature.

However, the logP values are most conveniently calculated by the "CLOGP" program, also available from Daylight CIS. This program also lists experimental logP values when they are available in the Pomona92 database. The "calculated logP" (ClogP) is determined by the fragment approach of Hansch and Leo (cf., A. Leo, in Comprehensive Medicinal Chemistry, Vol. 4, C. Hansch, P. G. Sammens, J. B. Taylor and C. A. Ransden, Eds., p. 295, Pergamon Press, 1990, incorporated herein by reference). The fragment approach is based on the chemical structure of each HR species, and takes into account the numbers and types of atoms, the atom connectivity, and chemical bonding. ClogP values are the most reliable and widely used estimates for octanol water partitioning. It will be understood by those skilled in the art that experimental log P values could also be used. Experimental log P values represent a less preferred embodiment of the invention. Where experimental log P values are used, the one hour log P values are preferred.

The compounds of the present invention comprise R units having a ClogP value greater than 1, preferably, greater than 2, more preferably greater than 3, most preferably greater than 4.

Phthalocyanine and Naphthalocyanine Ring Units

The phthalocyanine and naphthalocyanine rings useful for the purposes of the present invention may be substituted or unsubstituted. Phthalocyanines have sixteen possible sites of substitution; the $R^1$–$R^{16}$ units. The naphthalocyanines have twenty-four possible sites of substitution; the $R^1$–$R^{24}$ units. Each $R^1$–$R^{24}$ phthalocyanine or naphthalocyanine ring unit is independently selected from the group consisting of:

a) hydrogen;

b) halogen;

c) hydroxyl;

d) cyano:

e) nitrilo;

f) oximino;

g) $C_1$–$C_{22}$ alkyl, $C_3$–$C_{22}$ branched alkyl, $C_2$–$C_{22}$ alkenyl, $C_3$–$C_{22}$ branched alkenyl;

h) halogen substituted $C_1$–$C_{22}$ alkyl, $C_3$–$C_{22}$ branched alkyl, $C_2$–$C_{22}$ alkenyl, $C_3$–$C_{22}$ branched alkenyl;

i) polyhydroxyl substituted $C_3$–$C_{22}$ alkyl;

j) $C_1$–$C_{22}$ alkoxy, preferably $C_1$–$C_4$ alkoxy, more preferred methoxy;

k) branched alkoxy having the formula

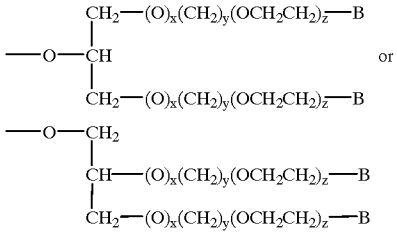

wherein B is hydrogen, hydroxyl, $C_1$–$C_{30}$ linear alkyl, $C_1$–$C_{30}$ branched alkyl, $C_1$–$C_{30}$ alkoxy, —$CO_2H$, —$OCH_2CO_2H$, —$SO_3^-M^+$, —$OSO_3^-M^+$, —$PO_3^{2-}M$, —$OPO_3^{2-}M$, and mixtures thereof; M is a water soluble cation in sufficient amount to satisfy charge balance; x is 0 or 1, each y independently has the value from 0 to 6, preferably from 0 to 6; each z independently has the value from 0 to 100, preferably from 0 to about 10, more preferably from 0 to about 3;

l) substituted aryl, and unsubstituted aryl having the formula:

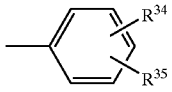

wherein $R^{34}$ and $R^{35}$ are independently selected from the group consisting of hydrogen, $C_1$–$C_6$ alkyl, $C_3$–$C_6$ alkenyl, $C_1$–$C_6$ alkoxy, $C_3$–$C_6$ branched alkoxy, halogen, —$CO_2^-M^+$, —$SO_3^-M^+$, —$OSO_3^-M^+$, —$N(R^{36})_2$, and —$N^+(R^{36})_3X^-$ wherein each $R^{36}$ is independently hydrogen or $C_1$–$C_4$ alkyl; and mixtures thereof; preferably hydrogen $C_1$–$C_6$ alkyl, —$CO_2^-M^+$, —$SO_3^-M^+$, —$OSO_3^-M^+$, and mixtures thereof, more preferably $R^{34}$ or $R^{35}$ is hydrogen and the other moiety is $C_1$–$C_6$ alkyl; wherein M is a water soluble cation and X is a water soluble anion.

m) substituted alkylenearyl and unsubstituted alkylenearyl having the formula:

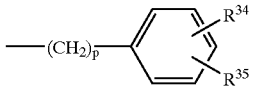

wherein $R^{34}$ and $R^{35}$ are as defined above.

n) substituted aryloxy and unsubstituted aryloxy having the formula:

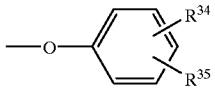

wherein $R^{34}$ and $R^{35}$ are as defined above.

o) substituted alkyleneoxyaryl and unsubstituted alkyleneoxyaryl units aredefined as moieties having the formula:

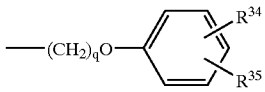

wherein $R^{34}$ and $R^{35}$ are as defined above.

p) substituted oxyalkylenearyl and unsubstituted oxyalkylenearyl having the formula:

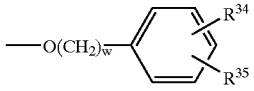

wherein $R^{34}$ and $R^{35}$ are as defined above.

q) $C_1$–$C_{22}$ linear, $C_3$–$C_{22}$ branched thioalkyl, $C_1$–$C_{22}$ linear, $C_3$–$C_{22}$ branched substituted thioalkyl, and mixtures thereof;

r) ester units of the formula —$CO_2R^{25}$ wherein $R^{25}$ is $C_1$–$C_{22}$ alkyl, $C_3$–$C_{22}$ branched alkyl, $C_2$–$C_{22}$ alkenyl, $C_3$–$C_{22}$ branched alkenyl, all of which can be substituted with halogen; poly-hydroxyl substituted $C_3$–$C_{22}$ alkyl, $C_3$–$C_{22}$ glycol; $C_1$–$C_{22}$ alkoxy, $C_3$–$C_{22}$ branched alkoxy; substituted and unsubstituted aryl, alkylenearyl, aryloxy, alkyleneoxyaryl, alkyleneoxyaryl; preferably $C_1$–$C_{22}$ alkyl, $C_3$–$C_{22}$ branched alkyl, and mixtures thereof;

s) alkyleneamino units having the formula:

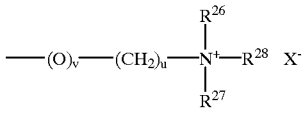

wherein $R^{26}$, and $R^{27}$ are each a $C_1$–$C_{22}$ alkyl, $C_3$–$C_{22}$ branched alkyl, $C_2$–$C_{22}$ alkenyl, $C_3$–$C_{22}$ branched alkenyl, $R^{28}$ is hydrogen, $C_1$–$C_{22}$ alkyl, $C_3$–$C_{22}$ branched alkyl, $C_2$–$C_{22}$ alkenyl, $C_3$–$C_{22}$ branched alkenyl and mixtures thereof, the index v is 0 or 1; X is a other water soluble anion, u is from 0 to 22, preferably u is from 3 to about 10. Examples of water soluble anions include organic species such as fumarate, tartrate, oxalate and the like, inorganic species include chloride, bromide, sulfate, hydrogen sulfate, phosphate and the like;

t) an amino unit of the formula $$—NR^{29}R^{30}$$

wherein $R^{29}$ and $R^{30}$ are each a $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

u) alkylethyleneoxy units having the formula:

$$—(A)_v—(CH_2)_y(OCH_2CH_2)_xZ$$

wherein Z is hydrogen, hydroxyl, $—CO_2H$, $—SO_3^-M^+$, $—OSO_3^-M^+$, $C_1$–$C_6$ alkoxy, substituted and unsubstituted aryl, substituted and unsubstituted aryloxy; alkyleneamino; or mixtures thereof; A units comprise nitrogen or oxygen, M is a water soluble cation; v is 0 or 1; x is from 0 to 100, preferably from 0 to 20, more preferably from 0 to 5; y is from 0 to 12, preferably from 1 to 4; however, no peroxide —O—O— bonds are contained within the photobleaching compounds of the present invention;

v) siloxy and substituted siloxy of the formula $—OSiR^{31}R^{32}R^{33}$ wherein each $R^{31}$, $R^{32}$, and $R^{33}$ is independently selected from the group consisting of $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof, substituted or unsubstituted aryl, aryloxy; alkylethyleneoxy units of the formula $$—(A)_v—(CH_2)_y(OCH_2CH_2)_xZ$$

wherein Z is hydrogen, hydroxyl, $C_1$–$C_{30}$ alkyl, $—CO_2H$, $—SO_3^-M^+$, $—OSO_3^-M^+$, $C_1$–$C_6$ alkoxy; substituted or unsubstituted aryl, and aryloxy; alkyleneamino, and mixtures thereof, preferably hydrogen or $C_1$–$C_6$ alkyl, more preferably methyl; v is 0 or 1; x is from 1 to 100, preferably from 0 to about 20, more preferably from 3 to about 10; and y is from 0 to 12, preferably from about 0 to about 5.

Preferred $R^1$–$R^{16}$ units for phthalocyanines and $R^1$–$R^{24}$ units for naphthalocyanines are hydrogen, halogen, and mixtures thereof, preferably chlorine, bromine, iodine, and mixtures thereof, more preferably bromine and iodine; $C_1$–$C_{22}$ alkoxy, preferably $C_1$–$C_4$ linear or branched alkoxy, more preferably methoxy; branched alkoxy having the formula

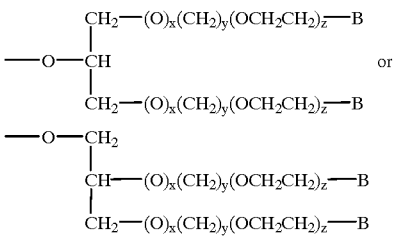

wherein B is hydroxy, $C_1$–$C_{10}$ alkyl, $—CO_2H$, $—SO_3^-M^+$, $—OSO_3^-M^+$, $—PO_3^{2-}M$, $—OPO_3^{2-}M$, and mixtures thereof; preferably hydroxy, $C_1$–$C_3$ alkyl, $—CO_2H$, $—SO_3^-M^+$, $—OSO_3^-M^+$; M is a water soluble cation in sufficient amount to satisfy charge balance; x is 0 or 1, each y independently has the value from 0 to 6, preferably from 0 to 3; each z independently has the value from 0 to 100, preferably from 0 to about 10, more preferably from 0 to about 3. When the metallocyanine ring unit is phthalocyanine most preferred $R^1$–$R^{16}$ units hydrogen, methoxy, branched alkoxy, and mixtures thereof. When the metallocyanine unit is naphthalocyanine still more preferred $R^1$–$R^{24}$ units are hydrogen, halogen and mixtures thereof, most preferred are hydrogen, chlorine, bromine, iodine, and mixtures thereof.

When compounds of the present invention have present one or more substituent $R^1$–$R^{16}$ units, as in the case of phthalocyanine, or $R^1$–$R^{24}$ units, as in the case of naphthalocyanines, the exact orientation of the substituents may not be exactly known. However, for the purposes of the compounds of the present invention, certain equivalencies of substitution exist. For example, the two units of the following formula

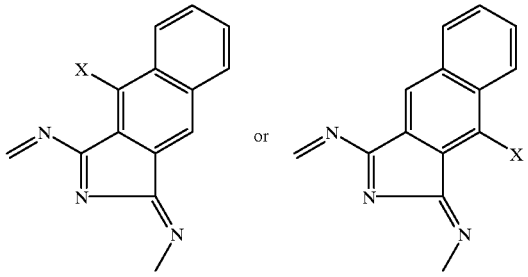

which comprise the same X moiety substitution, are equivalent.

In addition, compounds containing the substitution represented by the following formulas

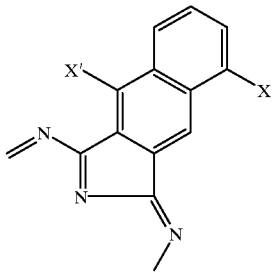

or

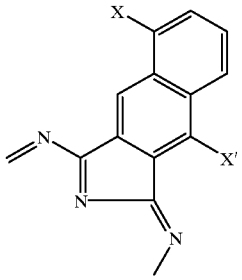

which contain the same X and X' unit substitutions, are also equivalent. The above examples, however, are only representative of the total number of equivalent structure examples that will be recognized by those skilled in the art.

Compounds useful for the present invention having substituted one or more $R^1$–$R^{16}$, unit, as in the case of phthalocyanine, or $R^1$–$R^{24}$ unit, as in the case of naphthalocyanines, which have their substitutions oriented in a manner described by the following formula

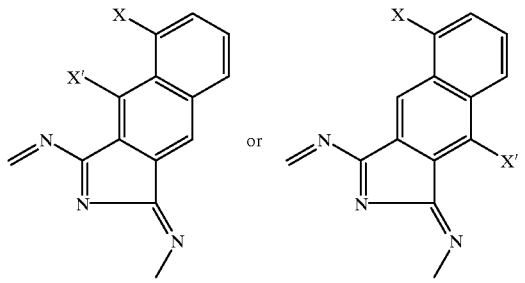

are not equivalent. The above example does not exhaust the number of non-equivalent structures that are possible using any combination of $R^1$–$R^{16}$ units or $R^1$–$R^{24}$ units recognized by those skilled in the art.

Axial R and T Units

The axial R and axial T units, are bonded directly to the central metal atom of the metallocyanine ring system. The central metal or non-metal atom may be any photoactive atom which enhances the photoactivity of the phthalocyanine or naphthalocyanine ring, preferred metals and non-metals include silicon, germanium, tin, lead, aluminum, platinum, palladium or phosphorous. However, the central metal or non-metal atom can not be para-magnetic. The utility of each R and T unit is primarily directed to providing the final photosensitizing compound with dingy stains/soil removal or bleaching properties. R units are non-ionic and T units are anionic.

Nonionic Axial R Units

According to the present invention the preferred axial R units comprise moieties having the formula:

$$—Y_i—L_j$$

wherein Y is a linking moiety selected from the group consisting of O, $CR^{41}R^{42}$,$OSiR^{41}R^{42}$, $OSnR^{41}R^{42}$, and mixtures thereof; wherein $R^{41}$ and $R^{42}$ are hydrogen, $C_1$–$C_4$ alkyl, halogen, and mixtures thereof; i is 0 or 1, j is from 1 to 3;

L is a ligand selected from the group consisting of:

a) $C_3$–$C_{30}$ linear alkyl, $C_3$–$C_{30}$ branched alkyl, $C_2$–$C_{30}$ linear alkenyl, $C_3$–$C_{30}$ branched alkenyl, $C_6$–$C_{20}$ aryl, $C_7$–$C_{20}$ arylalkyl, $C_7$–$C_{20}$ alkylaryl, and mixtures thereof;

b) an alkylethyleneoxy unit of the formula $$—(R^{39})_y(OR^{38})_xOZ$$

wherein Z is selected from the group consisting of hydrogen, $C_1$–$C_{20}$ alkyl, $C_3$–$C_{20}$ branched alkyl, $C_2$–$C_{20}$ linear alkenyl, $C_3$–$C_{20}$ branched alkenyl, $C_6$–$C_{20}$ aryl, $C_7$–$C_{30}$ arylalkyl, $C_6$–$C_{20}$ alkylaryl, and mixtures thereof; $R^{38}$ is selected from the group consisting of $C_1$–$C_4$ linear alkylene, $C_3$–$C_4$ branched alkylene, $C_3$–$C_6$ hydroxyalkylene, and mixtures thereof; $R^{39}$ is selected from the group consisting of $C_2$–$C_{20}$ alkyl, $C_6$–$C_{20}$ branched alkyl, $C_7$–$C_{20}$ aryl, $C_7$–$C_{30}$ arylalkyl, $C_7$–$C_{30}$ alkylaryl, and mixtures thereof; x is from 1 to 100; y is 0 or 1.

Preferred axial R units are alkyl alkyleneoxy units of the formula $$—(R^{39})_y(OR^{38})_xOZ$$

wherein Z is selected from the group consisting of hydrogen, $C_3$–$C_{20}$ linear alkyl, $C_3$–$C_{20}$ branched alkyl, $C_2$–$C_{20}$ linear alkenyl, $C_3$–$C_{20}$ branched alkenyl, $C_6$–$C_{10}$ aryl, $C_7$–$C_{20}$ arylalkyl, $C_7$–$C_{20}$ alkylaryl, and mixtures thereof; $R^{38}$ is selected from the group consisting of $C_1$–$C_4$ linear alkylene, $C_3$–$C_4$ branched alkylene, and mixtures thereof; $R^{39}$ is selected from the group consisting of $C_2$–$C_6$ alkylene, $C_3$–$C_6$ branched alkylene, $C_6$–$C_{10}$ arylene, and mixtures thereof; x is from 1 to 50; y is 0 or 1.

More preferred axial R units comprise y equal to 0, Z is hydrogen, $C_1$–$C_{20}$ alkyl, $C_3$–$C_{20}$ branched alkyl, $C_6$–$C_{10}$ aryl, and mixtures thereof, most preferred Z is hydrogen or $C_6$–$C_{20}$ linear alkyl, $C_{10}$–$C_{20}$ branched alkyl; $R^{38}$ is $C_1$–$C_4$ linear or $C_3$–$C_4$ branched alkylene.

Examples of Y units suitable for use in R units having the formula:

$$—Y_i—L_j$$

have the formula $$—O—L^1,\ —Sn—L^1,\ —OSn—L^1$$

wherein i is equal to 1 and j is equal to 1. Further examples have the formula

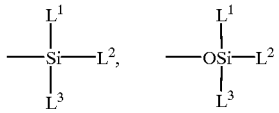

wherein i is equal to 1 and j is equal to 3.

Anionic Axial T Units

According to the present invention the preferred axial T units comprise moieties having the formula:

$$—Y_iQ_j$$

wherein Y is a linking moiety selected from the group consisting of O, $CR^{41}R^{42}$, $OSiR^{41}R^{42}$, $OSnR^{41}R^{42}$, and mixtures thereof; wherein $R^{41}$ and $R^{42}$ are hydrogen, $C_1$–$C_4$ alkyl, halogen, and mixtures thereof; i is 0 or 1, j is from 1 to 3;

Q is an ionic moiety having the formula:

$$—R^{40}—P$$

wherein $R^{40}$ is selected from the group consisting of $C_3$–$C_{30}$ linear alkylene, $C_3$–$C_{30}$ branched alkylene, $C_2$–$C_{30}$ linear alkenylene, $C_3$–$C_{30}$ branched alkenylene, $C_6$–$C_{16}$ arylene, and mixtures thereof; P is selected from the group consisting of $—CO_2^-M^+$, $—SO_3^-M^+$, $—OSO_3^-M^+$; $PO_3^{2-}M^+$, $—OPO_3^-M^+$, $—N^+(R^{36})_3X^-$; M is a water soluble cation of sufficient charge to provide electronic neutrality and X is a water soluble anion as defined herein above.

Preferred T units having the formula:

$$—Y_i—Q_j$$

wherein Y is a linking moiety selected from the group consisting of O, $CR^{41}R^{42}$, $OSiR^{41}R^{42}$, $OSnR^{41}R^{42}$, and mixtures thereof; i is 0 or 1, j is from 1 to 3; Q is an ionic moiety having the formula:

$$—R^{40}—P$$

wherein $R^{40}$ is selected from the group consisting of $C_3$–$C_{20}$ linear alkyl, $C_3$–$C_{20}$ branched alkyl, $C_2$–$C_{20}$ linear alkenyl, $C_3$–$C_{20}$ branched alkenyl, $C_6$–$C_{10}$ aryl, and mixtures thereof; P is selected from the group consisting of $—CO_2^-$ $M^+$, $—SO_3^-M^+$, $—OSO_3^-M^+$; $PO_3^{2-}M^+$, $—OPO_3^-M^+$; wherein $R^{36}$ is independently hydrogen, $C_1$–$C_6$ alkyl, $—(CH_2)_nOH$, $—(CH_2CH_2O)_nH$, and mixtures thereof; wherein n is from 1 to 4; M is a water soluble cation of sufficient charge to provide electronic neutrality and X is a water soluble anion as defined herein above.

A preferred hydrophilic T has the index i equal to 1; $R^{40}$ is $C_3$–$C_{20}$ linear alkyl, $C_3$–$C_{20}$ branched alkyl; P is $—CO_2^-M^+$, $—SO_3^-M^+$, $—OSO_3^-M^+$; M is a water soluble cation of sufficient charge to provide electronic neutrality.

Examples of Y units suitable for use in T units having the formula:

$$—Y_i—Q_j$$

have the formula $$—O—L^1,\ —Sn—L^1,\ —OSn—L^1$$

wherein i is equal to 1 and j is equal to 1. Further examples have the formula

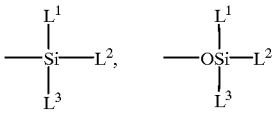

wherein i is equal to 1 and j is equal to 3.

The present invention also relates to a method for making a photobleaching compound which is suitable for use on fabric which has dingy stains in need of removal. Key to the method described herein is the selection of one or more axial R moieties by determining the ClogP of the corresponding HR adduct.

The method according to the present invention for producing a photobleaching compound effective for cleaning stained fabric having a dingy stain in need of cleaning comprises the steps of:

a) selecting a photosensitizer unit, said photosensitizer unit selected form the group consisting of substituted or unsubstituted phthalocyanine or naphthalocyanine;

b) reacting the photosensitizer unit with a photoactive metal or non-metal selected from the group consisting of silicon, germanium, tin, lead, aluminum, platinum, palladium, phosphorous, and mixtures thereof to form a metallocyanine unit;

c) selecting a moiety for use as an R axial moiety;

d) determining the ClogP of the axial moiety conjugate HR form, wherein the ClogP of the HR form must be greater than 1, preferably greater than 2, more preferably greater than 3. most preferably greater than 4;

e) optionally selecting a T unit: and f) reacting together the metallocyanine unit with the axial R unit and the T unit to form a photobleaching compound having the formula:

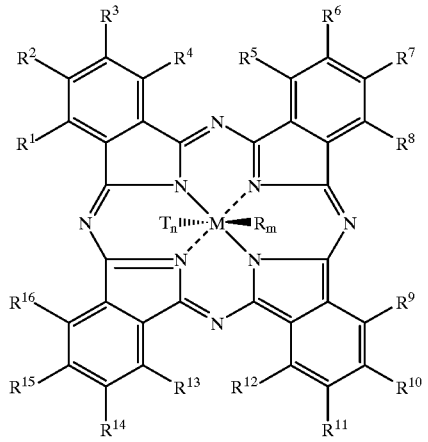

or the formula:

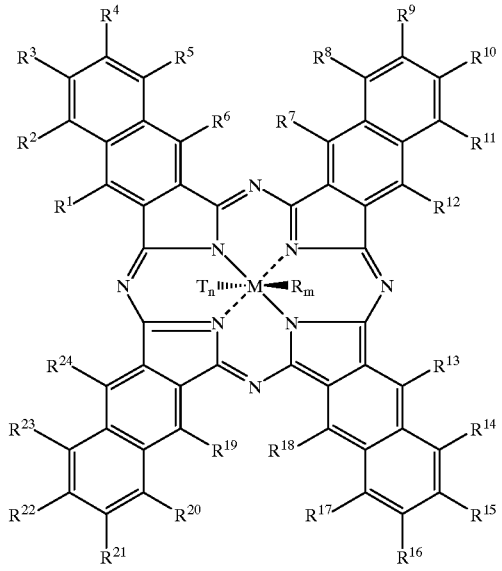

provided that when n is equal to 1, m is equal to 1 and when m is equal to 2 n is equal to 0.

The photobleaching compounds produced by the present method are the same materials described herein above.

The present invention also encompasses a method for photobleaching fabric with the photobleaches described herein. The method comprises contacting a stained fabric in need of bleaching with a photobleaching compound according to the present invention followed by exposing the surface of the treated fabric to a source of light having wavelengths in the range from about 300 to about 1200 nanometers.

Present invention also relates to a method of cleaning hard surfaces in need of cleaning, said method comprises contacting a hard surface in need of cleaning with a photobleaching compound according to the present invention followed by exposing the surface of the treated fabric to a source of light having wavelengths in the range from about 300 to about 1200 nanometers.

Preferred photobleaches of the present invention are "low hue" photobleaches. The term "low hue" as used herein and throughout the specification refers to photobleaches that have a $\lambda_{max}$ of their Q-band above about 700 nm.

The present invention also relates to a process for carrying out a photo-bleaching reaction by singlet oxygen, wherein one or more phthalocyanine or naphthylocyanine compounds in the presence of oxygen, are brought into contact with the medium in which or on which the said reaction is to take place and are irradiated with light.

It has long been known that certain large conjugated adducts, such as phthalocyanine and naphthalocyanine rings, can absorb light quanta and form electronically excited species (singlet and triplet) and that these species can be quenched by oxygen to yield 'excited oxygen species'. A particularly preferred 'excited oxygen species' is singlet oxygen which is most reliably formed by the quenching of the triplet state of a photosensitizer, such as a phthalocyanine, by molecular oxygen. It is therefore an aim of the photobleach formulator to produce compounds that favor the formation of the triplet state.

The molecules of the present invention, can be modified by the formulator to increase the quantum efficiency by which the triplet state is formed by selection of "heavy atom" substituents. Heavy atom substituents are halogens, preferably bromine or iodine. The selection of a "heavy atom" substituent can be made independently of other factors, for example, without undue concern for dingy performance. This is because the choice of axial R and axial T groups for dingy performance will have no bearing on the changes made to the phthalocyanine or naphthalocyanine ring system.

The Q-band, a term understood by those skilled in the art, is the main (strongest) absorption band of the phthalocyanines. In the case of the phthalocyanines and napthalocyanines of the present invention, the wavelength associated with this absorption is typically from 600 to 800 nanometers. This range encompasses wavelengths of both the visible and the near infrared spectrum and gives the phthalocyanines and naphthalocyanines their distinctive colors.

The determination of the value of the Q-band wavelength and whether a shift occurs in this wavelength when a particular moiety ($R^1$–$R^{24}$ unit) replaces a hydrogen atom on the phthalocyanine or naphthalocyanine ring is straightforward. Typically, a solution having a concentration of approximately $1\times10^{-6}$ M of the phthalocyanine or naphthalocyanine to be measured is prepared using a suitable solvent (e.g. dimethylformamide) which contains 1 wt % triton X-100. A UV/visible spectrum is then obtained and the Q-band $\lambda_{max}$ is recorded. This value is defined as "$\lambda_{s\text{-}max}$". A spectrum for the material prior to introduction of the substituent group, i.e. where H replaces the substituent, is obtained in the same manner. This value is defined as "$\lambda_{r\text{-}max}$". The two spectra are compared and the resulting measured values are placed into the following equation $$\text{wavelength red shift}=\Delta\lambda_{max}=\lambda_{s\text{-}max}-\lambda_{r\text{-}max}$$

if $\Delta\lambda_{max}$ is greater than or equal to 1, then the substituent group is particularly suitable as a substituent for the metallocyanines of the present invention.

Quantum yields and excited state energies are well known to those skilled in the art and the procedures for the determination of triplet quantum yield and like photophysical parameters are thoroughly described in the following references Bonnet, R.; McGarvey, D. J.; Harriman, A.; Land, E. J.; Truscott, T. G.; Winfield, *U-J. Photochem. Photobiol.* 1988, 48 (3), pg. 271–6; Davila, J., Harriman, A., Gulliya, K. S., *Photochem. Photobiol.,* 1991, 53 (1), pg. 1–11; Davila, J., Harriman, A., *Photochem. Photobiol.,* 1989, 50 (1), pg. 29–35; Charlesworth, P., Truscottt, T. G., Brooks, R. C., Wilson, B. C., *J. Photochem, Photobiol.*, part B 1994, 26 (3), pg. 277–82; Zhang, X., Xu, H., *J. Chem. Soc.*, Faraday Trans., 1993, 89 (18), pg. 3347–51; Simpson, M. S. C., Beeby, A., Bishop, S. M., MacRobert, A. J., Parker, A. W., Phillips, D., *Proc. SPIE-int. Soc. Opt. Eng.,* 1992, 1640, pg. 520–9; Phillips, D., *Pure Appl. Chem.,* 1995, 67 (1), pg. 117–26; Wilkinson, F., Helman, W. P., Ross, A. B., *J. Phys. Chem.* Ref. Data, 1993, 22 (1), pg. 113–262; Lever, A. P. B., Licoccia, S., Magnell, K., Minor, P. C., Ramaswamy, B. S., *Adv. Chem. Ser.,* 1982, 201, pg. 237–52; West, M. A., *Creat. Detect. Excited State,* 1976, 4, pg. 217–307; Ford, W. E., Rihter, B. D., Kenney, M. E., Rodgers, M. A. J., *Photochem. Photobiol.,* 1989, 50 (3), pg. 277–282; Firey, P. A., Ford, W. E., Sounik, J. R., Kenney, M. E., Rodgers, A. J. R., *J. Am. Chem. Soc.,* 1988, 110, pg. 7626–7630; Firey, P. A., Rodgers, M. A. J., *Photochem. Photobiol.,* 1987, 45 (4), pg. 535–8; all of which are incorporated by reference in their entirety.

For the purposes of the present invention the delta triplet percentage (%) quantum yield is determined according to the following equation $$\text{triplet state yield increase}=\Delta\Phi_{trip}=\Phi_{trip\text{-}substrate}-\Phi_{trip\text{-}reference}$$

wherein substrate or reference are as defined above and when the value for $\Delta\Phi_{trip}$ is a number greater than or equal to 1, the substituent group is particularly suitable as a substituent for the metallocyanines of the present invention.

The present invention also relates to process for bleaching or removing spots from textiles and removing stains in or on organic or inorganic substrates in the presence of water and while being irradiated by light.

Another advantage of the present invention is the fact that each R and T unit may be directed toward a separate desired property and the molecules of the present invention can therefore be thought of as being "sided". For example, the axial T unit may be direct toward increased solubility while the axial R group may be chosen for its ability to provide dingy cleaning as described herein.

The irradiation can be effected by means of an artificial source of light or by means of sunlight. A good effect is achieved with light of 300 and 2500 nm, but preferably in the range of from 600 to about 1000 nm. The intensity and duration of light exposure may be varied to achieve the desired dingy stain removal.

The irradiation with light can either be carried out directly in the treatment medium, by means of an artificial source of light or the articles, in a moist state, can subsequently either be irradiated, again by means of an artificial source of light, for instance in the dryer, or can be exposed to sunlight.

The methods of the present invention can also be accomplished in solvent based carriers or in low aqueous solutions. Solvents that are capable of holding solublized oxygen are preferred. Non-limiting examples of these solvents are butoxy propoxy propanol (BPP), methoxy propoxy propanol (MPP), ethoxy propoxy propanol (EPP), and propoxy propoxy propanol (PPP). Embodiments of the present invention which comprise these non-classical aqueous compositions are most useful when the photobleach must be applied to a woven fabric or surface that contains agents which repel water and moisture.

Surface bleaching can be achieved, for example by applying to the appropriate surface, an aqueous solution of the phthalocyanine or naphthalocyanine compound according to the present invention, this solution preferably comprising from about 0.001 to about 10%, by weight of active substance. The solution can also comprise, in addition, other customary additives, for example wetting agents, dispersing agents or emulsifiers, detergent substances and, if desired inorganic salts. After this solution has been applied, the surface is simply exposed to sunlight or, if required, it can in addition be irradiated by means of an artificial source of light. It is preferable the surface be kept moist during the exposure to light.

The cleaning compositions of the present invention optionally comprise detersive surfactants, examples of which are, anionic, cationic, nonionic, amphoteric and zwitterionic, however the formulator is not limited to these examples or combinations thereof. The surfactants are present from about 0% to about 95%, preferably from about 5% to about 30%, by weight of the composition.

The cleaning compositions of the present invention optionally comprise detersive surfactants, examples of which are, anionic, cationic, nonionic, amphoteric and zwitterionic, however the formulator is not limited to these examples or combinations thereof. The surfactants are present from about 0% to about 50%, preferably from about 5% to about 30%, by weight of the composition.

The cleaning compositions of the present invention optionally contains builders, examples of which are, silicates, carbonates, and zeolites, however the user is not limited to these examples or combinations thereof. The builders are present from about 0% to about 50%, preferably from about 5% to about 30%, by weight of the composition.

The cleaning compositions of the present invention optionally contains builders, examples of which are, silicates, carbonates, and zeolites, however the user is not limited to these examples or combinations thereof. The builders are present from about 0% to about 50%, preferably from about 5% to about 30%, by weight of the composition.

The hard surface cleaner of the present invention optionally contains builders, examples of which are, silicates, carbonates, and zeolites, however the user is not limited to these examples or combinations thereof. The builders are present from about 0% to about 50%, preferably from about 5% to about 30%, by weight of the composition.

The hard surface cleaner of the present invention optionally contains abrasives from about 0.5% to about 85%, preferably from about 10% to about 85%, by weight of the composition. Suitable abrasives are silicates, carbonates, perlite, clay, and pulverized ceramic clay, however, the user is not restricted to these examples or combinations thereof.

The present invention also relates to a process for carrying out a photo-bleaching reaction, wherein one or more phthalocyanine or naphthylocyanine compounds in the presence of oxygen, are brought into contact with the medium in which or on which the said reaction is to take place, or are incorporated in this medium, and are irradiated with light.

Substances which increase the action can also be added in the process according to the invention, inter alia electrolytes, for example inorganic salts, for instance sodium chloride, potassium chloride, sodium sulfate, potassium sulfate, sodium acetate ammonium acetate, alkali metal phosphates and alkali metal tri-polyphosphates, especially sodium chloride and sodium sulfate. These salts can be added to the agents according to the invention or can be added directly in the application method, so that they are present in the application solution in a concentration of, preferably 0.1 to 10%, by weight.

Surfactant

The instant cleaning compositions contain from about 0.1% to about 60% by weight of a surfactant selected from the group consisting of anionic, nonionic, ampholytic and zwitterinonic surface active agents. For liquid systems, surfactant is preferably present to the extent of from about 0.1% to 20% by weight of the composition. For solid (i.e. granular) and viscous semi-solid (i.e. gelatinous, pastes, etc.) systems, surfactant is preferably present to the extent of from about 1.5% to 30% by weight of the composition.

Nonlimiting examples of surfactants useful herein typically at levels from about 1% to about 55%, by weight, include the conventional $C_{11}$–$C_{18}$ alkyl benzene sulfonates ("LAS") and primary, branched-chain and random $C_{10}$–$C_{20}$ alkyl sulfates ("AS"), the $C_{10}$–$C_{18}$ secondary (2,3) alkyl sulfates of the formula $CH_3(CH_2)_x(CHOSO_3^-M^+)$ $CH_3$ and $CH_3(CH_2)_y(CHOSO_3^-M^+)CH_2CH_3$ where x and (y+1) are integers of at least about 7, preferably at least about 9, and M is a water-solubilizing cation, especially sodium, unsaturated sulfates such as oleyl sulfate, the $C_{10}$–$C_{18}$ alkyl alkoxy sulfates ("$AE_xS$"; especially EO 1–7 ethoxy sulfates), $C_{10}$–$C_{18}$ alkyl alkoxy carboxylates (especially the EO 1–5 ethoxycarboxylates), the $C_{10-18}$ glycerol ethers, the $C_{10}$–$C_{18}$ alkyl polyglycosides and their corresponding sulfated polyglycosides, and $C_{12}$–$C_{18}$ alpha-sulfonated fatty acid esters. If desired, the conventional nonionic and amphoteric surfactants such as the $C_{12}$–$C_{18}$ alkyl ethoxylates ("AE") including the so-called narrow peaked alkyl ethoxylates and $C_6$–$C_{12}$ alkyl phenol alkoxylates (especially ethoxylates and mixed ethoxy/propoxy), $C_{12}$–$C_{18}$ betaines and sulfobetaines ("sultaines"), $C_{10}$–$C_{18}$ amine oxides, and the like, can also be included in the overall compositions. The $C_{10}$–$C_{18}$ N-alkyl polyhydroxy fatty acid amides can also be used. Typical examples include the $C_{12}$–$C_{18}$ N-methylglucamides. See WO 9,206,154. Other sugar-derived surfactants include the N-alkoxy polyhydroxy fatty acid amides, such as $C_{10}$–$C_{18}$ N-(3-methoxypropyl) glucamide. The N-propyl through N-hexyl $C_{12}$–$C_{18}$ glucamides can be used for low sudsing. $C_{10}$–$C_{20}$ conventional soaps may also be used. If high sudsing is desired, the branched-chain $C_{10}$–$C_{16}$ soaps may be used. Mixtures of anionic and nonionic surfactants are especially useful. Other conventional useful surfactants are described further herein and are listed in standard texts.

Anionic surfactants can be broadly described as the water-soluble salts, particularly the alkali metal salts, of organic sulfuric reaction products having in their molecular structure an alkyl radical containing from about 8 to about 22 carbon atoms and a radical selected from the group consisting of sulfonic acid and sulfuric acid ester radicals. (Included in the term alkyl is the alkyl portion of higher acyl radicals.) Important examples of the anionic synthetic detergents which can form the surfactant component of the compositions of the present invention are the sodium or potassium alkyl sulfates, especially those obtained by sulfating the higher alcohols (C8–18 carbon atoms) produced by reducing the glycerides of tallow or coconut oil; sodium or potassium alkyl benzene sulfonates, in which the alkyl group contains from about 9 to about 15 carbon atoms, (the alkyl radical can be a straight or branched aliphatic chain); sodium alkyl glyceryl ether sulfonates, especially those ethers of the higher alcohols derived from tallow and coconut oil; sodium coconut oil fatty acid monoglyceride sulfates and sulfonates; sodium or potassium salts of sulfuric acid ester of the reaction product of one mole of a higher fatty alcohol (e.g. tallow or coconut alcohols) and about 1 to about 10 moles of ethylene oxide; sodium or potassium salts of alkyl phenol ethylene oxide ether sulfates with about 1 to about 10 units of ethylene oxide per molecule and in which the alkyl radicals contain from 8 to 12 carbon atoms; the reaction products of fatty acids are derived from coconut oil sodium or potassium salts of tatty acid amides of a methyl tauride in which the fatty acids, for example, are derived from coconut oil and sodium or potassium beta-acetoxy- or beta-acetamido-alkanesulfonates where the alkane has from 8 to 22 carbon atoms.

Additionally, secondary alkyl sulfates may be used by the formulator exclusively or in conjunction with other surfactant materials and the following identifies and illustrates the differences between sulfated surfactants and otherwise conventional alkyl sulfate surfactants. Non-limiting examples of such ingredients are as follows.

Conventional primary alkyl sulfates (LAS), such as those illustrated above, have the general formula ROSO3–M+ wherein R is typically a linear C8–22 hydrocarbyl group and M is a water solublizing cation, for example sodium LAS. Branched chain primary alkyl sulfate surfactants (i.e., branched-chain "PAS") having 8–20 carbon atoms are also know; see, for example, Eur. Pat. Appl. 439,316, Smith et al., filed Jan. 21, 1991.

Conventional secondary alkyl sulfate surfactants are those materials which have the sulfate moiety distributed randomly along the hydrocarbyl "backbone" of the molecule. Such materials may be depicted by the structure $$CH_3(CH_2)_n(CHOSO_3^-M^+)(CH_2)_mCH_3$$

wherein m and n are integers of 2 of greater and the sum of m+n is typically about 9 to 17, and M is a water-solublizing cation.

The aforementioned secondary alkyl sulfates are those prepared by the addition of $H_2SO_4$ to olefins. A typical synthesis using alpha olefins and sulfuric acid is disclosed in U.S. Pat. No. 3,234,258, Morris, issued Feb. 8, 1966 or in U.S. Pat. No. 5,075,041, Lutz, issued Dec. 24,1991. The synthesis conducted in solvents which afford the secondary (2,3) alkyl sulfates on cooling, yields products which, when purified to remove the unreacted materials, randomly sulfated materials, unsulfated by-products such as C10 and higher alcohols, secondary olefin sulfonates, and the like, are typically 90+% pure mixtures of 2- and 3-sulfated materials (some sodium sulfate may be present) and are white, non tacky, apparently crystalline, solids. Some 2,3-disulfates may also be present, but generally comprise no more than 5% of the mixture of secondary (2,3) alkyl mono-sulfates. Such materials are available as under the name "DAN", e.g., "DAN 200" from Shell Oil Company.

Bleaching Agents and Bleach Activators

The cleaning compositions herein may optionally contain bleaching agents or bleaching compositions containing a bleaching agent and one or more bleach activators. When present, bleaching agents will typically be at levels of from about 1% to about 30%, more typically from about 5% to about 20%, of the detergent composition, especially for fabric laundering. If present, the amount of bleach activators will typically be from about 0.1% to about 60%, more typically from about 0.5% to about 40% of the bleaching composition comprising the bleaching agent-plus-bleach activator.

The bleaching agents used herein can be any of the bleaching agents useful for detergent compositions in textile cleaning, hard surface cleaning, or other cleaning purposes that are now known or become known. These include oxygen bleaches other than the hypohalite (e.g. hypochlorite) bleaches. Perborate (e.g., mono- or tetrahydrate sodium salts) and percarbonate bleaches can be used herein.

Another category of bleaching agent that can be used without restriction encompasses percarboxylic acid bleaching agents and salts thereof. Suitable examples of this class of agents include magnesium monoperoxyphthalate hexahydrate, the magnesium salt of metachloro perbenzoic acid, 4-nonylamino-4-oxoperoxybutyric acid and diperoxydodecanedioic acid. Such bleaching agents are disclosed in U.S. Pat. No. 4,483,781, Hartman, issued Nov. 20, 1984, U.S. patent application Ser. No. 740,446, Burns et al, filed Jun. 3, 1985, European Patent Application 0,133,354, Banks et al, published Feb. 20, 1985, and U.S. Pat. No. 4,412,934, Chung et al, issued Nov. 1, 1983. Highly preferred bleaching agents also include 6-nonylamino-6-oxoperoxycaproic acid as described in U.S. Pat. No. 4,634,551, issued Jan. 6, 1987 to Burns et al.

Peroxygen bleaching agents can also be used. Suitable peroxygen bleaching compounds include sodium carbonate peroxyhydrate and equivalent "percarbonate" bleaches, sodium pyrophosphate peroxyhydrate, urea peroxyhydrate, and sodium peroxide. Persulfate bleach (e.g., OXONE, manufactured commercially by DuPont) can also be used.

A preferred percarbonate bleach comprises dry particles having an average particle size in the range from about 500 micrometers to about 1,000 micrometers, not more than about 10% by weight of said particles being smaller than about 200 micrometers and not more than about 10% by weight of said particles being larger than about 1,250 micrometers. Optionally, the percarbonate can be coated with silicate, borate or water-soluble surfactants. Percarbonate is available from various commercial sources such as FMC, Solvay and Tokai Denka.

Mixtures of bleaching agents can also be used.

Peroxygen bleaching agents, the perborates, the percarbonates, etc., are preferably combined with bleach activators, which lead to the in situ production in aqueous solution (i.e., during the washing process) of the peroxy acid corresponding to the bleach activator. Various nonlimiting examples of activators are disclosed in U.S. Pat. No. 4,915,854, issued Apr. 10, 1990 to Mao et al. and U.S. Pat. No. 4,412,934. The nonanoyloxybenzene sulfonate (NOBS) and tetraacetyl ethylene diamine (TAED) activators are typical, and mixtures thereof can also be used. See also U.S. Pat. No. 4,634,551 for other typical bleaches and activators useful herein.

Highly preferred amido-derived bleach activators are those of the formulae:

$$R^1N(R^5)C(O)R^2C(O)L$$

or $$R^1C(O)N(R^5)R^2C(O)L$$

wherein $R^1$ is an alkyl group containing from about 6 to about 12 carbon atoms, $R^2$ is an alkylene containing from 1 to about 6 carbon atoms, $R^5$ is H or alkyl, aryl, or alkaryl containing from about 1 to about 10 carbon atoms, and L is any suitable leaving group. A leaving group is any group that is displaced from the bleach activator as a consequence of the nucleophilic attack on the bleach activator by the perhydrolysis anion. A preferred leaving group is phenyl sulfonate.

Preferred examples of bleach activators of the above formulae include (6-octanamido-caproyl) oxybenzenesulfonate, (6-nonanamidocaproyl) oxybenzenesulfonate, (6-decanamido-caproyl) oxybenzenesulfonate, and mixtures thereof as described in U.S. Pat. No. 4,634,551, incorporated herein by reference.

Another class of bleach activators comprises the benzoxazin-type activators disclosed by Hodge et al in U.S. Pat. No. 4,966,723, issued Oct. 30, 1990, incorporated herein by reference. A highly preferred activator of the benzoxazin-type is:

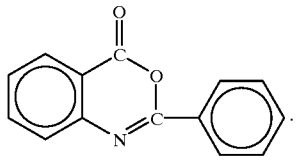

Still another class of preferred bleach activators includes the acyl lactam activators, especially acyl caprolactams and acyl valerolactams of the formulae:

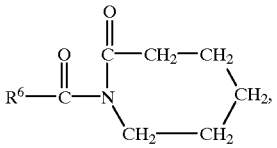

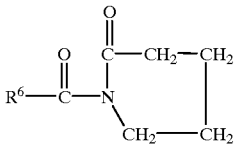

wherein $R^6$ is H or an alkyl, aryl, alkoxyaryl, or alkaryl group containing from 1 to about 12 carbon atoms. Highly preferred lactam activators include benzoyl caprolactam, octanoyl caprolactam, 3,5,5-trimethylhexanoyl caprolactam, nonanoyl caprolactam, decanoyl caprolactam, undecenoyl caprolactam, benzoyl valerolactam, octanoyl valerolactam, decanoyl valerolactam, undecenoyl valerolactam, nonanoyl valerolactam, 3,5,5-trimethylhexanoyl valerolactam and mixtures thereof. See also U.S. Pat. No. 4,545,784, issued to Sanderson, Oct. 8, 1985. incorporated herein by reference, which discloses acyl caprolactams, including benzoyl caprolactam, adsorbed into sodium perborate.

As a practical matter, and not by way of limitation, the compositions and processes herein can be adjusted to provide on the order of at least one part per ten million of the active bleach catalyst species in the aqueous washing liquor, and will preferably provide from about 0.1 ppm to about 700 ppm, more preferably from about 1 ppm to about 500 ppm, of the catalyst species in the laundry liquor.

Bleaching agents other than oxygen bleaching agents are also known in the art and can be utilized herein. One type of non-oxygen bleaching agent of particular interest includes photoactivated bleaching agents such as the sulfonated zinc and/or aluminum phthalocyanines. See U.S. Pat. No. 4,033,718. issued Jul. 5, 1977 to Holcombe et al. If used, detergent compositions will typically contain from about 0.025% to about 1.25%, by weight, of such bleaches, especially sulfonate zinc phthalocyanine.

Buffers

Buffers can be included in the formulations herein for a variety of purposes. One such purpose is to adjust the cleaning surface pH to optimize the hard surface cleaner composition effectiveness relative to a particular type of soil or stain. Buffers may be included to stabilize the adjunct ingredients with respect to extended shelf life or for the purpose of maintaining compatibility between various aesthetic ingredients. The hard surface cleaner of the present invention optionally contains buffers to adjust the pH in a range from about 7 to about 13, preferably from about 8 to about 13, more preferably from about 10 to about 11. Non-limiting examples of such suitable buffers are potassium carbonate, sodium carbonate, and sodium bicarbonate, however, the formulator is not restricted to these examples or combinations thereof.

Adjunct Materials

The cleaning compositions herein can optionally include one or more other detergent adjunct materials or other materials for assisting or enhancing cleaning performance, treatment of the surface to be cleaned, or to modify the aesthetics of the composition (e.g., perfumes, colorants, dyes, etc.). The following are illustrative examples of such adjunct materials but are not meant to be exclusive or limiting in scope.

Chelating Agents

The cleaning compositions herein may also optionally contain one or more iron and/or manganese chelating agents. Such chelating agents can be selected from the group consisting of amino carboxylates, amino phosphonates, polyfunctionally-substituted aromatic chelating agents and mixtures therein, all as hereinafter defined. Without intending to be bound by theory, it is believed that the benefit of these materials is due in part to their exceptional ability to remove iron and manganese ions from washing solutions by formation of soluble chelates.

Amino carboxylates useful as optional chelating agents include ethylenediaminetetracetates, N-hydroxyethylethylenediaminetriacetates, nitrilotriacetates, ethylenediamine tetraproprionates, triethylenetetraaminehexacetates, diethylenetriaminepentaacetates, and ethanoldiglycines, alkali metal, ammonium, and substituted ammonium salts therein and mixtures therein.

Amino phosphonates are also suitable for use as chelating agents in the compositions of the invention when at lease low levels of total phosphorus are permitted in detergent compositions, and include ethylenediaminetetrakis (methylenephosphonates) as DEQUEST. Preferred, these amino phosphonates to not contain alkyl or alkenyl groups with more than about 6 carbon atoms.

Polyfunctionally-substituted aromatic chelating agents are also useful in the compositions herein. See U.S. Pat. No. 3,812,044, issued May 21, 1974, to Connor et al.

Preferred compounds of this type in acid form are dihydroxydisulfobenzenes such as 1,2-dihydroxy-3,5-disulfobenzene.

A preferred biodegradable chelator for use herein is ethylenediamine disuccinate ("EDDS"), especially the [S,S] isomer as described in U.S. Pat. No. 4,704,233, Nov. 3, 1987, to Hartman and Perkins.

If utilized, these chelating agents will generally comprise from about 0.1% to about 10% by weight of the detergent compositions herein. More preferably, if utilized, the chelating agents will comprise from about 0.1% to about 3.0% by weight of such compositions Inert Salts. The inert salts (filler salts) used in the compositions of the present invention can be any water-soluble inorganic or organic salt or mixtures of such salts which do not destabilize the surfactant. For the purposed of the present invention, "water-soluble" means having a solubility in water of at least 1 gram per 100 grams of water at 20° C. Examples of suitable salts include various alkali metal and/or alkali earth metal sulfate, chlorides, borates, bromides, fluorides, phosphates, carbonates, bicarbonates, citrates, acetates, lactates, etc.

Specific examples of suitable salts include sodium sulfate, sodium chloride, potassium chloride, sodium carbonate, potassium sulfate, lithium chloride, lithium sulfate, tripotassium phosphate, sodium borate, potassium bromide, potassium fluoride, sodium bicarbonate, magnesium sulfate, magnesium chloride, sodium citrate, sodium acetate, magnesium lactate, sodium fluoride. The preferred salts are inorganic salts preferably the alkali metal sulfates and chlorides. Particularly preferred salts, because of their low cost are sodium sulfate and sodium chloride. The salts are present in the compositions at levels of from 0% to 40%, preferably 10% to 20%.

Abrasives.

An essential component of many solid or viscous semi-solid hard surface cleaning compositions is the abrasive material added to facilitate the action of scouring. Abrasive scouring cleansers provide a convenient and useful means for carrying out the sanitizing of porcelain and tile surfaces, especially tubs, showers and toilet bowls. The particulate abrasive material within such compositions serves to abrade and loosen soil adhering to hard surfaces and further serves to create more intimate contact between hard surface stain and the surfactant and/or bleaching agents also present in the cleansing compositions.

Abrasive cleaners have traditionally contained water-insoluble, relatively hard, particulate mineral material as the abrasive agent. The most common such abrasive agent is finely divided silica sand having particle size varying between about 1 and 300 microns and specific gravity of about 2.1 or higher. While such material is generally very effective in scouring soil and stains from the surfaces being treated, abrasive material of this type tends to be difficult to rinse away from the toilet bowl, shower or bathtub surface.

In the case where moderate or highly water soluble abrasive material is required (i.e. sodium carbonate) imidodisulfate can be used as the sole abrasive or otherwise added in part.

It has been discovered that abrasive compositions of this desired type can be realized by utilizing a particular type of expanded perlite abrasive in combination with the surfactants, filler material, and other optional scouring material ingredients listed herein. The abrasive materials suitable to the present invention are those contained in U.S. Pat. No. 4,051,056, Hartman, issued Sep. 27, 1977 and included herein by reference.

Perfumes.

Perfumes are an important ingredient especially for the liquid composition embodiment. Perfume is usually used at levels of from 0% to 5%. In U.S. Pat. No. 4,246,129, Kacher, issued Jan. 20, 1981 (incorporated herein by reference), certain perfume materials are disclosed which perform the added function reducing the solubility of anionic sulfonate and sulfate surfactants.

Dyes.

Dyes may be include at levels of from abut 0.5% to 12%, preferably 1.5% to 5%. Solids and viscous semi-solids can be made with 1.5% dye and no perfume. Examples of suitable dyes are Alizarine Light Blue B (C.I. 63010), Carta Blue VP (C.I. 24401), Acid Green 2G (C.I. 42085), Astrogen Green D (C.I. 42040), Supranol Cyanine 7B (C.I. 42675, Maxilon Blue 3RL (C.I. Basic Blue 80), Drimarine Blue Z-RL (C.I. Reactive Blue 18), Alizarine Light Blue H-RL (C.I. Acid Blue 182), FD&C Blue No. 1 and FD&C Green No. 3. (See the patents of Kitko, U.S. Pat. No. 4,248,827 issued Feb. 3, 1981 and U.S. Pat. No. 4,200,606, issued Apr. 29, 1980, both incorporated herein by reference.) C.I. refers to Color Index.

Optional Adjunct Ingredients.

As a preferred embodiment, the conventional adjunct ingredients employed herein can be selected from typical components such as enzymes (compatible with the applicable with other adjunct ingredients), especially proteases, lipases, cellulases, color speckles, suds boosters, suds supressors, anti-tarnish and/or anti-corrosion agents, soil-suspending agents, germicides, alkalinity sources, hydrotropes, anti-oxidants, enzyme stabilizing agents, solvents, clay soil chelating agents will generally comprise from about 0.1% to about 10% by weight of the detergent compositions herein. More preferably, if utilized, the chelating agents will comprise from about 0.1% to about 3.0% by weight of such composition removal/anti-redeposition agents, polymeric dispersing agents, dye transfer inhibiting agents, including polyamine N-oxides such as polyvinylpyrrolidone and copolymers of N-vinyl imidazole and N-vinyl pyrrolidone, etc.

EXAMPLE 1

Preparation of 1,4-Dimethoxy-2,3-dicyanobenzene

Dimethyl sulfate (15 mL, 0.16 mol) and anhydrous potassium carbonate (24 g, 0.17 mol) are added to a solution of 2,3-dicyanohydroquinone (3.0 g, 0.019 mol) in 100 mL 2-butanone. The reaction mixture is refluxed for 18 hr. under a stream of argon, cooled to room temperature and the resulting solid is collected by filtration. The residue is added to water (100 ml) to dissolve the potassium carbonate and the resulting insoluble material is collected by filtration and dried under vacuum to yield 3.10 g (88%), m.p. 276–280° C., $^1$H NMR (DMSO-$d_6$) in ppm, $\delta$=7.63 (s, 2 H), 3.93 (s, 6 H).

EXAMPLE 2

Preparation of octamethoxy phthalocyanine di-lithium salt

Lithium methoxide (6.05 g, 0.16 mol) is added to a solution of 1,4-dimethoxy-2,3-dicyanobenzene (10 g, 0.05 mol) in 100 mL anhydrous methanol. The reaction mixture is pressurized to approximately 2000–2400 psi with nitrogen gas, heated to 120° C. for 6 hr., cooled to room temperature and vented to atmospheric pressure. The resulting gray/green solid is collected by filtration and dried under vacuum to yield 7.08 g (70%). Q-band $\lambda_{max}$ at 714 nm (DMF).

EXAMPLE 3

Preparation of octamethoxy phthalocyanine p-Toluene sulfonic acid (15.73 g, 91 mmol) is added to a solution of octamethoxy phthalocyanine di-lithium salt (7.0 g, 9.1 mmol) in 100 mL anhydrous DMF at 50° C. The reaction mixture is stirred at 50° C. 8 hr. under a stream of argon, cooled to approximately 10° C. for 2 hr. and the resulting purple solid is collected by filtration and dried under vacuum to yield 4.91 g (71%). Q-band $\lambda_{max}$ at 764 nm (DMF).

EXAMPLE 4

Preparation of silicon (IV) octamethoxyphthalocyanine dichloride

Silicon tetrachloride (8 mL, 31.8 mmol) is added to a frozen mixture of octamethoxy phthalocyanine (1.0 g, 0.66 mmol) in 60 mL anhydrous pyridine. The reaction mixture is pressurized to ~2000–2400 psi with nitrogen gas, heated to 180° C. for 24 hr., cooled to room temperature and vented to atmospheric pressure. The product is precipitated by the addition of water and the resulting solid is collected by filtration. The filtrate is dissolved in methanol, precipitated by the addition of 1N hydrochloric acid and collected by filtration. The product is purified by silica gel chromatography using methylene chloride as the eluent. Yield of green product is 0.55 g (49%). Q-band $\lambda_{max}$ at 730 nm (DMF).

EXAMPLE 5

Preparation of silicon(IV) phthalocyanine dichloride

To a 100 mL reaction vessel is charged 1,3-diiminoisoindoline (1.0 g, 6.9 mmole) and 15 mL of anhydrous quinoline. While stirring at room temperature and under argon blanketing, silicon tetrachloride (1.65 g, 9.6 mmole) is added. The reaction is warmed to reflux over 30 minutes then held at reflux for an additional 30 minutes. After cooling, methanol (30 mL) is added and the reaction solution is allowed to stand for 8 hours. The resulting blue precipitate (0.659 g) is collected, dried and used without further purification. Q-band $\lambda_{max}$ at 669 nm (DMF)

EXAMPLE 6

Preparation of silicon 2,3-naphthalocyanine dichloride

To a 100 mL reaction vessel is charged 13-diiminobenz (f)-isoindoline (1.35 g, 6.9 mmole) and 15 mL of anhydrous quinoline. While stirring at room temperature and under argon blanketing, silicon tetrachloride (1.65 g, 9.6 mmole) is added. The reaction is warmed to reflux over 30 minutes then held at reflux for an additional 30 minutes. After cooling, methanol (30 mL) is added and the reaction solution is allowed to stand for 8 hours. The resulting green precipitate (0.931 g) is collected, dried and used without further purification. Q-band $\lambda_{max}$ at 782 nm (DMF)

EXAMPLE 7

Preparation of silicon(IV) phthalocyanine dihydroxide

To a solution of concentrated sulfiuic acid (30 mL) is added silicon(IV) phthalocyanine dichloride (1.0 g, 1.64 mmole). The resulting mixture is stirred for 6 hours at room temperature. The solution is then added dropwise to ammonium hydroxide at 0° C. over a period of approximately one hour. The blue precipitate (0.87 g) that forms is collected by filtration, dried and used without further purification. Q-band $\lambda_{max}$ at 669 nm (DMF).

EXAMPLE 8

Preparation of silicon 2,3-naphthalocyanine dihydroxide

To a solution of concentrated sulfuric acid (30 mL) is added silicon(IV) 2,3-naphthalocyanine dichloride (1.0 g, 1.23 mmole). The resulting mixture is stirred for 6 hours at room temperature. The solution is then added dropwise to ammonium hydroxide at 0° C. over a period of approximately one hour. The green precipitate (0.80 g) that forms is collected by filtration, dried and used without further purification. Q-band $\lambda_{max}$ at 782 nm (DMF).

EXAMPLE 9

Preparation of silicon(IV) phthalocyanine di-(Neodol 35-30)

To a 500 mL flask is charged silicon(IV) phthalocyanine dihydroxide (1.0 g, 1.73 mmole), Neodol 35-30 (79.81 g, 51.9 mmole) and xylene (175 mL). The reaction vessel is fitted for azeotropic removal of water and solution is slowly heated to reflux over 3 hours then held at reflux for 48 hours. After cooling the solvent is removed in vacuo and the blue oil (81.09 g) obtained is used without further purification. Q-band $\lambda_{max}$ at 674 nm. (water).

EXAMPLE 10

Preparation of silicon(IV) phthalocyanine di-(Neodol 23-6.5)

To a 500 mL flask is charged silicon(IV) phthalocyanine dihydroxide (1.0 g, 1.73 mmole), Neodol 23-6.5 (24.86 g, 51.9 mmole) and xylene (175 mL). The reaction vessel is fitted for azeotropic removal of water and solution is slowly heated to reflux over 3 hours then held at reflux for 48 hours. After cooling the solvent is removed in vacuo and the blue oil (25.92 g) obtained is used without further purification. Q-band $\lambda_{max}$ at 674 nm. (water).

EXAMPLE 11

Preparation of silicon(IV) phthalocyanine di-(Neodol 25-3)

To a 500 mL flask is charged silicon(IV) phthalocyanine dihydroxide (1.0 g, 1.73 mmole), Neodol 25-3 (17.59 g, 51.9 mmole) and xylene (175 mL). The reaction vessel is fitted for azeotropic removal of water and solution is slowly heated to reflux over 3 hours then held at reflux for 48 hours. After cooling the solvent is removed in vacuo and the blue oil (18.71 g) obtained is used without further purification.

EXAMPLE 12

Preparation of silicon(IV) phthalocyanine di-(Glycerol-di-(Neodol 23-6.5))

To a 500 mL flask is charged silicon(IV) phthalocyanine dihydroxide (1.0 g, 1.73 mmole), Glycerol-di-(Neodol 23-6.5) (52.60 g, 51.9 mmole) and xylene (175 mL). The reaction vessel is fitted for azeotropic removal of water and solution is slowly heated to reflux over 3 hours then held at reflux for 48 hours. After cooling the solvent is removed in vacuo and the blue oil (54.81 g) obtained is used without further purification.

EXAMPLE 13

Preparation of silicon(IV) phthalocyanine di-(1-tetradecoxide)

To a 500 mL flask is charged silicon(IV) phthalocyanine dihydroxide (1.0 g, 1.73 mmole), 1-tetradecanol (11.13 g, 51.9 mmole) and xylene (175 mL). The reaction vessel is fitted for azeotropic removal of water and solution is slowly heated to reflux over 3 hours then held at reflux for 48 hours. After cooling the volume is concentrated to about 20 mL and methanol is added (100 mL). The resulting blue precipitate is collected (1.35 g). Q-band $\lambda_{max}$ at 674 nm. (chloroform).

EXAMPLE 14

Preparation of silicon(IV) phthalocyanine di-(1-eicosanoxide)

To a 500 mL flask is charged silicon(IV) phthalocyanine dihydroxide (1.0 g, 1.73 mmole), 1-eicosanol (15.50 g, 51.9 mmole) and xylene (175 mL). The reaction vessel is fitted for azeotropic removal of water and solution is slowly heated to reflux over 3 hours then held at reflux for 48 hours. After cooling the volume is concentrated to about 20 mL and methanol is added (100 mL). The resulting blue precipitate is collected (1.65 g).

EXAMPLE 15

Preparation of silicon(IV) 2,3-naphthalocyanine di-(Neodol 35-30)

To a 500 mL flask is charged silicon(IV) 2,3-naphthalocyanine dihydroxide (1.0 g, 1.29 mmole), Neodol 35-30 (53.4 g, 38.7 mmole) and xylene (175 mL). The reaction vessel is fitted for azeotropic removal of water and solution is slowly heated to reflux over 3 hours then held at reflux for 72 hours. After cooling to room temperature the solution is concentrated in vacuo to yield 55.1 g of a green oil that is used without further purification.

EXAMPLE 16

Preparation of silicon(IV) 2,3-naphthalocyanine di-(Glycerol-di-(Neodol 23-6.5))

To a 500 mL flask is charged silicon(IV) 2,3-naphthalocyanine dihydroxide (1.0 g, 1.29 mmole), Glycerol-di-(Neodol 23-6.5) (39.22 g, 38.7 mmole) and xylene (175 mL). The reaction vessel is fitted for azeotropic removal of water and solution is slowly heated to reflux over 3 hours then held at reflux for 72 hours. After cooling to room temperature the solution is concentrated in vacuo to yield 39.82 g of a green oil that is used without further purification.

EXAMPLE 17

Preparation of silicon(IV) 2.3-naphthalocyanine di-(1-eicosanoxide)

To a 500 mL flask is charged silicon(IV) 2,3-naphthalocyanine dihydroxide (1.0 g, 1.29 mmole), 1-tetradecanol (11.55 g, 38.7 mmole) and xylene (175 mL). The reaction vessel is fitted for azeotropic removal of water and solution is slowly heated to reflux over 3 hours then held at reflux for 72 hours. The solution is cooled to room temperature and the volume reduced to approximately 20 mL. Methanol is added (100 mL) and the resulting green precipitate is collected to yield 1.54 g.

EXAMPLE 18

Preparation of octamethoxysilicon(IV) phthalocyanine di-(Neodol35-30)

To a 500 mL flask is charged silicon(IV) 2,3-naphthalocyanine dihydroxide (1.0 g, 1.29 mmole), Neodol 35-30 (50.84 g, 36.8 mmole) and xylene (175 mL). The reaction vessel is fitted for azeotropic removal of water and solution is slowly heated to reflux over 3 hours then held at reflux for 72 hours. The solution is cooled and the solvent removed in vacuo to yield 52.1 g of a green oil that is used without further purification.

EXAMPLE 19

Preparation of octamethoxysilicon(IV) phthalocyanine di-(Neodol25-3)

To a 500 mL flask is charged silicon(IV) 2,3-naphthalocyanine dihydroxide (1.0 g, 1.29 mmole), Neodol 25-3 (37.23 g, 36.8 mmole)and xylene (175 mL). The reaction vessel is fitted for azeotropic removal of water and solution is slowly heated to reflux over 3 hours then held at reflux for 72 hours. The solution is cooled and the solvent removed in vacuo to yield 38.41 g of a green oil that is used without further purification.

EXAMPLE 20

Preparation of Glycerol-di-(NEODOL 23-6.5T) [DNG]

Neodol 23-6.5 (383.2 g, 0.80 moles) is added dropwise to a suspension of sodium hydride (20.4 g, 0.85 moles) in anhydrous p-dioxane (500 ml) at room temperature over a period of one hour. After stirring and additional hour epichlorohydrin (37.0 g, 0.40 moles) is added in one portion. The solution is then slowly heated to reflux over a period of 2 hours then held at reflux temperature for 48 hours. Cool in an ice bath and added concentrated HCl (100 mL) at a rate that maintains the solution temperature below 40° C. After neutralization is complete the solution is concentrated in vacuo to remove the solvent and any unreacted NEODOL 23-6.5T. The crude product is purified over silica gel (THF) and the resulting brown oil (344.77 g) is used with out further purification.

The cleaning compositions provided in accordance with this invention may be in the form of granules, liquids, bars, and the like, and typically are formulated to provide an in-use pH in the range of 9 to 11, however in the case of non-aqueous or low aqueous compositions the pH ranges may vary outside this range. Various carriers such as sodium sulfate, water, water-ethanol, BPP, MPP, EPP, PPP, sodium carbonate, and the like, may be used routinely to formulate the finished products. Granules may be produced by spray-drying or by agglomeration, using known techniques, to provide products in the density range of 350–950 g/l. Bars may be formulated using conventional extrusion techniques. The compositions may also contain conventional perfumes, bactericides, hydrotropes and the like. In the case of non-aqueous or low aqueous compositions, the cleaning compositions may be applied to an article which is used to deliver the compositions of the present invention to a fabric or to a hard surface. Non-limiting examples of compositions according to this invention are as follows:

| | weight % | | | |
|---|---|---|---|---|
| Ingredients | 21 | 22 | 23 | 24 |
| Sodium LAS | 15 | 30 | 20 | 25 |
| NEODOL | 1 | 1 | 1 | 1 |
| Alkyl Dimethyl Ammonium Chloride | 0.5 | 1 | 0.5 | 0.7 |
| Sodium Tripolyphosphate | 15 | 35 | 22 | 28 |
| Sodium Carbonate | 10 | 10 | 15 | 15 |
| SOKALAN | 2 | 2 | 2 | 2 |
| Carboxymethyl Cellulose | 1 | 1 | 1 | 1 |
| Tinopal CBS-X | 0.1 | 0.1 | 0.1 | 0.1 |
| Soil Release Agent[1] | 0.2 | 0.2 | 0.3 | 0.3 |
| Savinase 6.0 T | 0.3 | 0.6 | 0.5 | 0.6 |
| BAN 300 T | 0.2 | 0.5 | 0.5 | 0.6 |
| Lipolase 100 T | 0.1 | 0.2 | 0.2 | 0.3 |
| CAREZYME 5 T | 0.1 | 0.2 | 0.2 | 0.3 |
| Sodium Perborate | — | — | 3.0 | 5.0 |
| NOBS | — | — | 2.0 | 3.0 |
| Photobleach[2] (ppm) | 0.005 | 0.01 | — | — |

-continued

| Ingredients | weight % | | | |
|---|---|---|---|---|
| | 21 | 22 | 23 | 24 |
| Photobleach[3] (ppm) | — | — | 0.008 | 0.01 |
| Moisture + Sodium Sulfate + Perfume + Miscellaneous | Balance | Balance | Balance | Balance |

[1]Soil Release Agent according to U.S. Pat. No. 5,415,807 Gosselink et al., issued May 16, 1995.
[2]Photobleach according to Example 12.
[3]Photobleach according to Example 16.

1. Soil Release Agent according to U.S. Pat. No. 5,415,807 Gosselink et al., issued May 16, 1995.
2. Photobleach according to Example 12.
3. Photobleach according to Example 16.

| Ingredients | Weight % | | |
|---|---|---|---|
| | 25 | 26 | 27 |
| Zeolite | 38 | 35 | 30 |
| Silicate 2.0 R | 6 | 4 | 7 |
| Carbonate (sodium) | 9 | 10 | 4 |
| Ethylene diamine tetramethylenphosphonate | 0.2 | 0.1 | 0.3 |
| Brightener 47 | 0.1 | 0.15 | 0.1 |
| Brightener 49 | 0.05 | — | 0.05 |
| Percarbonate | 8 | 5 | 10 |
| NOBS | — | — | 3 |
| TAED | 7 | — | — |
| Savinase (4.0 KNPU/g) | 2 | 1.5 | 2 |
| Lipolase (100 000 LU/g) | 0.2 | 0.5 | 0.5 |
| C12–C14 alkyl Sulphate | 6 | 6 | 8 |
| C12–C14 AE4.2 nonionic | 11 | 12 | 10 |
| Soap | 1 | — | — |
| Photobleach[1] (ppm) | 0.01 | — | — |
| Photobleach[2] (ppm) | — | 0.1 | — |
| Photobleach[3] (ppm) | — | — | 0.1 |
| Miscellaneous/Moisture Balance | 100 | 100 | 100 |

[1]Photobleach according to Example 16.
[2]Photobleach according to Example 19.
[3]Photobleach according to Example 15.

EXAMPLE 28

Granular Laundry Detergent

| Ingredients | Weight % |
|---|---|
| Anionic alkyl sulfate | 7 |
| Nonionic surfactant | 5 |
| Zeolite | 10 |
| Trisodium citrate | 2 |
| SKS-6 silicate builder | 10 |
| Acrylate/maleate copolymer | 4 |
| Sodium percarbonate | 25 |
| Sodium carbonate | 5 |
| Ethylenediamine disuccinate | 0.4 |
| Suds suppressor | 2 |
| Enzymes | 1.5 |
| Photobleach[1] (ppm) | 0.01 |
| Miscellaneous/Moisture Balance | 100 |

[1]Photobleach according to Example 6.

The above embodiment may be allowed to fully dry prior to exposure. After exposure, reactivation with a solution produces more desirable properties.

EXAMPLE 29

Laundry bar composition

| Ingredients | Weight % |
|---|---|
| $C_{12}$ Linear alkyl benzene sulphonate | 30 |
| Phosphate (as sodium tripolyphosphate) | 7 |
| Sodium carbonate | 15 |
| Sodium pyrophosphate | 7 |
| Coconut monoethanolamide | 2 |
| Zeolite A | 5 |
| Carboxymethylcellulose | 0.2 |
| Polyacrylate (m.w. 1400) | 0.2 |
| Sodium percarbonate | 15 |
| Protease | 0.3 |
| $CaSO_4$ | 1 |
| $MgSO_4$ | 1 |
| Photobleach[1] (ppm) | 0.01 |
| Miscellaneous/Moisture Balance | 100 |

[1]Photobleach according to Example 13.

EXAMPLE 30

Low aqueous cleaning composition

| Ingredients | % (wt.) Formula Range |
|---|---|
| Photobleach[1] (ppm) | 0.005–1.5 |
| BPP[2] | 5–25 |
| 1,2-octanediol | 0.1–7.0 |
| $MgAE_1S$ | 0.01–0.8 |
| $MgAE_{6.5}S$ | 0.01–0.8 |
| $C_{12}$ Dimethyl Amine Oxide | 0.01–0.8 |
| PEMULEN[3] | 0.05–0.20 |
| perfume | 0.01–1.5 |
| water | balance |
| pH range from about 6 to about 8 | |

[1]Photobleach according to Example 11.
[2]Other co-solvents which can be used herein together with the BPP, MPP, EPP and PPP primary solvents include various glycol ethers, including materials marketed under trademarks such as Carbitiol, methyl Carbitol, butyl Carbitol, propyl Carbitol, hexyl Cellosolve, and the like. If desired, and having due regard for safety and odor for in-home use, various conventional chlorinated and hydrocarbon dry cleaning solvents may also be used. Included among these are 1,2-dichloroethane, trichloroethylene, isoparaffins, and mixtures thereof.
[3]As disclosed in U.S. Pat. Nos. 4,758,641 and 5,004,557, such polycarylates include homopolymers which may be crosslinked to varying degrees, as well as non-crosslinked. Preferred herein are homopolymers having a molecular weight in the range of from about 100,000 to about 10,000,000, preferably 2000,000 to 5,000,000.

Fabrics are laundered using the foregoing compositions, typically at usage concentrations of from about 10 ppm to about 10,000 ppm. The fabrics are dried in the presence of light, preferably natural sunlight, to achieve improved photobleaching benefits.

What is claimed is:

1. A cleaning composition comprising:

a) at least about 0.001 ppm, of a metallocyanine photobleach compound selected from substituted or unsubstituted phthalocyanines and naphthalocyanines complexed with a photoactive metal or non-metal selected from the group consisting of silicon, germanium, tin, lead, aluminum, platinum, palladium, phosphorous and mixtures thereof; and wherein further said photoactive metal is bonded to at least one nonionic moiety having a ClogP value greater than 1;

b) at least about 0.1%, by weight, of a detersive surfactant; and c) the balance carriers and adjunct materials.

2. A photobleach composition comprising:

A) at least about 0.001 ppm, of an metallocyanine photobleach compound having a Q-band maximum absorption wavelength of 660 nanometers or greater said metallocyanine photobleach compound is a phthalocyanine having the formula

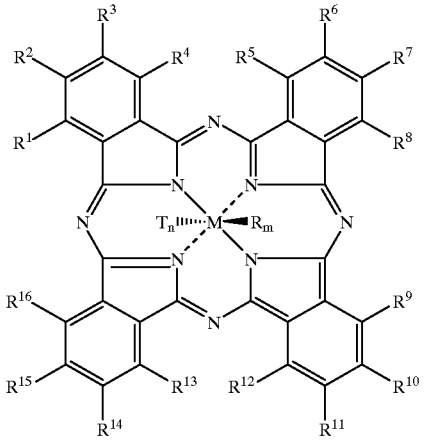

or the formula:

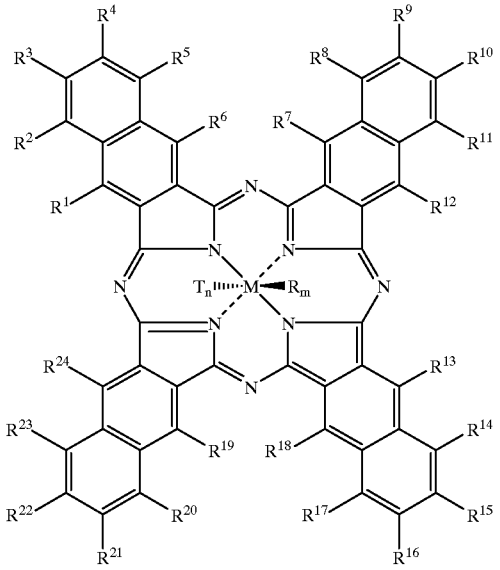

comprising:

a) a photoactive metal or non-metal M, preferably M is selected from the group consisting of silicon, germanium, tin, lead, aluminum, platinum, palladium, phosphorous, and mixtures thereof;

b) a phthalocyanine photosensitizing ring having the formula:

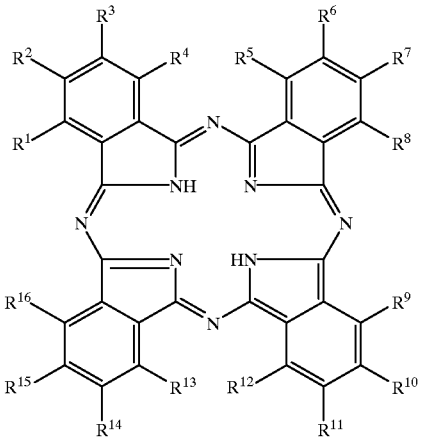

or a naphthalocyanine photosensitizing ring having the formula:

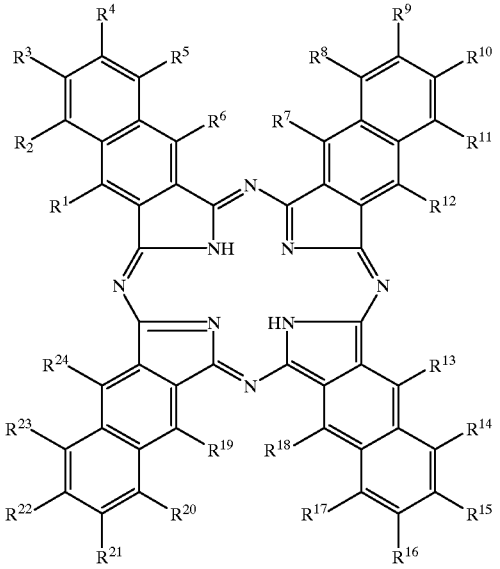

wherein $R^1$ through $R^{24}$ are each independently selected from the group consisting of:

a) hydrogen;

b) halogen;

c) hydroxyl;

d) cyano;

e) nitrilo;

f) oximino;

g) $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

h) halogen substituted $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

i) polyhydroxyl substituted $C_3$–$C_{22}$ alkyl;

j) $C_1$–$C_{22}$ alkoxy;

k) branched alkoxy having the formula

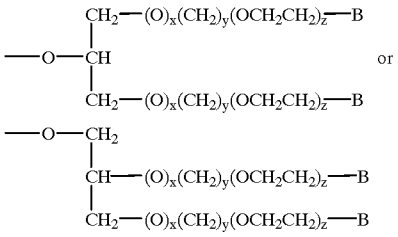

wherein B is hydrogen, hydroxyl, $C_1$–$C_{30}$ alkyl, $C_1$–$C_{30}$ alkoxy, —$CO_2H$, —$CH_2CO_2H$, —$SO_3^-M^+$, —$OSO_3^-M^+$, —$PO_3^{2-}M$, —$OPO_3^{2-}M$, and mixtures thereof, M is a water soluble cation in sufficient amount to satisfy charge balance; x is 0 or 1, each y independently has the value from 0 to 6, each z independently has the value from 0 to 100;

l) substituted and unsubstituted aryl;

m) substituted and unsubstituted alkylenearyl;

n) substituted and unsubstituted aryloxy;

o) substituted and unsubstituted oxyalkylenearyl;

p) substituted and unsubstituted alkyleneoxyaryl;

q) $C_1$–$C_{22}$ linear, $C_3$–$C_{22}$ branched thioalkyl, $C_1$–$C_{22}$ linear, $C_3$–$C_{22}$ branched substituted thioalkyl, and mixtures thereof;

r) an ester of the formula —$CO_2R^{25}$ wherein $R^{25}$ comprises i) $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

ii) halogen substituted $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

iii) polyhydroxyl substituted $C_3$–$C_{22}$ alkyl;

iv) $C_3$–$C_{22}$ glycol;

v) $C_1$–$C_{22}$ alkoxy;

vi) $C_3$–$C_{22}$ branched alkoxy;

vii) substituted and unsubstituted aryl;

viii) substituted and unsubstituted alkylaryl;

ix) substituted and unsubstituted aryloxy;

x) substituted and unsubstituted alkoxyaryl;

xi) substituted and unsubstituted alkyleneoxyaryl; or mixtures thereof;

s) an alkyleneamino unit of the formula

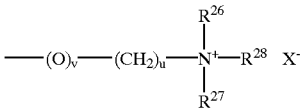

wherein $R^{26}$ and $R^{27}$ comprises $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

$R^{28}$ comprises:

i) hydrogen;

ii) $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

A units comprise nitrogen or oxygen; X comprises chlorine, bromine, iodine, or other water soluble anion, v is 0 or 1, u is from 0 to 22;

t) an amino unit of the formula

—$NR^{29}R^{30}$ wherein $R^{29}$ and $R^{30}$ comprises $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

u) an alkylethyleneoxy unit of the formula

—$(A)_v$—$(CH_2)_y(OCH_2CH_2)_xZ$ wherein Z comprises:

i) hydrogen;

ii) hydroxyl;

iii) —$CO_2H$;

iv) —$SO_3^-M^+$;

v) —$OSO_3^-M^+$;

vi) $C_1$–$C_6$ alkoxy;

vii) substituted and unsubstituted aryl;

viii) substituted and unsubstituted aryloxy;

ix) alkyleneamino; or mixtures thereof;

A units comprise nitrogen or oxygen, M is a water soluble cation, v is 0 or 1, x is from 0 to 100, y is from 0 to 12;

v) substituted siloxy of the formula:

—$OSiR^{31}R^{32}R^{33}$ wherein each $R^{31}$, $R^{32}$, and $R^{33}$ is independently selected from the group consisting of:

i) $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

ii) substituted and unsubstituted aryl;

iii) substituted and unsubstituted aryloxy;

iv) an alkylethyleneoxy unit of the formula

—$(A)_v$—$(CH_2)_y(OCH_2CH_2)_xZ$;

wherein Z comprises:

a) hydrogen;

b) $C_1$–$C_{30}$ alkyl, c) hydroxyl;

d) —$CO_2H$;

e) —$SO_3^-M^+$;

f) —$OSO_3^-M^+$;

g) $C_1$–$C_6$ alkoxy;

h) substituted and unsubstituted aryl;

i) substituted and unsubstituted aryloxy;

j) alkyleneamino; or mixtures thereof;

A units comprise nitrogen or oxygen, M is a water soluble cation, v is 0 or 1, x is from 0 to 100, y is from 0 to 12;

and mixtures thereof;

c) R units wherein the R units are axial, said R units are a hydrophobic moiety that when in the conjugate HR form have an octanol/water ClogP of greater than 1; m has the value 1 or 2;

d) T units wherein the T units are axial, said T units are anionic moieties; n has the value 0 or 1; provided that when n is equal to 1 then m is equal to 1, and when m is equal to 2 then n is equal to 0; and B) from about 0.1 to about 95%, by weight, a detersive surfactant said surfactant is a member selected from the group consisting of anionic, cationic, nonionic, ampholytic, and zwitterionic surfactants, and mixtures thereof; and C) the balance adjunct ingredients said adjunct ingredients selected from the group consisting of buffers, builders, chelants, filler salts, soil release agents, dispersants, enzymes, enzyme boosters, perfumes, thickeners, abrasives, solvents, clays, bleaches, and mixtures thereof.

3. A composition according to claim 2 wherein the hydrophobic axial R units comprises moieties having the formula:

$—Y_i—L_j$ wherein Y is a linking moiety selected from the group consisting of O, $CR^{41}R^{42}$, $OSiR^{41}R^{42}$, $OSnR^{41}R^{42}$ and mixtures thereof; wherein $R^{41}$ and $R^{42}$ are hydrogen, $C_1$–$C_4$ alkyl, halogen, and mixtures thereof; i is 0 or 1, j is from 1 to 3;

L is a ligand selected from the group consisting of:

a) $C_3$–$C_{30}$ linear alkyl, $C_3$–$C_{30}$ branched alkyl, $C_2$–$C_{30}$ linear alkenyl, $C_3$–$C_{30}$ branched alkenyl, $C_6$–$C_{20}$ aryl, $C_7$–$C_{20}$ arylalkyl, $C_7$–$C_{20}$ alkylaryl;

b) an alkylethyleneoxy unit of the formula $—(R^{39})_y(OR^{38})_xOZ$ wherein Z is hydrogen, $C_1$–$C_{20}$ alkyl, $C_3$–$C_{20}$ branched alkyl, $C_2$–$C_{20}$ linear alkenyl, $C_3$–$C_{20}$ branched alkenyl, $C_6$–$C_{20}$ aryl, $C_7$–$C_{30}$ arylalkyl, $C_6$–$C_{20}$ alkylaryl; $R^{38}$ is $C_1$–$C_4$ linear alkylene, $C_1$–$C_4$ branched alkylene, $C_3$–$C_6$ hydroxyalkylene, and mixtures thereof; $R^{39}$ is selected from the group consisting of $C_2$–$C_{20}$ alkylene, $C_6$–$C_{20}$ branched alkylene, $C_7$–$C_{20}$ arylene, $C_7$–$C_{30}$ arylalkylene, $C_7$–$C_{30}$ alkylarylene; x is from 1 to 100; y is 0 or 1; and c) mixtures thereof.

4. A composition according to claim 3 wherein the hydrophobic axial R unit is an alkylethyleneoxy unit of the formula $—(R^{39})_y(OR^{38})_xOZ$ wherein Z is selected from the group consisting of hydrogen, $C_3$–$C_{20}$ linear alkyl, $C_3$–$C_{20}$ branched alkyl, $C_2$–$C_{20}$ linear alkenyl, $C_3$–$C_{20}$ branched alkenyl, $C_6$–$C_{10}$ aryl, and mixtures thereof; $R^{38}$ is selected from the group consisting of $C_1$–$C_4$ linear alkylene, $C_1$–$C_4$ branched alkylene, and mixtures thereof; $R^{39}$ is selected from the group consisting of $C_1$–$C_6$ alkylene, $C_1$–$C_6$ branched alkylene, $C_6$–$C_{10}$ arylene, and mixtures thereof; x is from 1 to 50; y is 0 or 1.

5. A composition according to claim 4 wherein y is equal to 0, Z is selected from the group consisting of hydrogen, $C_1$–$C_{20}$ alkyl, $C_3$–$C_{20}$ branched alkyl, $C_5$–$C_{20}$ aryl, $C_6$–$C_{20}$ arylalkyl, $C_6$–$C_{20}$ alkylaryl, and mixtures thereof, preferably hydrogen, $C_1$–$C_{20}$ alkyl, or $C_3$–$C_{20}$ branched alkyl, more preferably hydrogen or methyl; $R^{38}$ is $C_1$–$C_4$ linear alkylene.

6. A composition according to claim 2 wherein the axial T unit comprises moieties having the formula:

$—Y_i—Q_j$ wherein Y is a linking moiety selected from the group consisting of O, $CR^{41}R^{42}$, $OSiR^{41}R^{42}$, $OSnR^{41}R^{42}$, and mixtures thereof; wherein $R^{41}$ and $R^{42}$ are hydrogen, $C_1$–$C_4$ alkyl, halogen, and mixtures thereof; i is 0 or 1, j is from 1 to 3;

Q is an anionic moiety having the formula:

$—R^{40}—P$ wherein $R^{40}$ is selected from the group consisting of $C_3$–$C_{30}$ linear alkyl, $C_3$–$C_{30}$ branched alkyl, $C_2$–$C_{30}$ linear alkenyl, $C_3$–$C_{30}$ branched alkenyl, $C_6$–$C_{16}$ aryl, and mixtures thereof; P is selected from the group consisting of $—CO_2^-M^+$, $—SO_3^-M^+$, $—OSO_3^-M^+$; $PO_3^{2-}M^+$, $—OPO_3^-M^+$, M is a water soluble cation of sufficient charge to provide electronic neutrality.

7. A composition according to claim 6 wherein i is equal to 0; Q is an anionic moiety having the formula:

$—R^{40}—P$ wherein $R^{40}$ is $C_1$–$C_{20}$ alkyl, and mixtures thereof, preferably $C_1$–$C_{20}$ alkyl; P is selected from the group consisting of $—CO_2^-M^+$, $—SO_3^-M^+$, $—OSO_3^-M^+$; $PO_3^{2-}M^+$, $—OPO_3^-M^+$, preferably $—SO_3^-M^+$; M is a water soluble cation of sufficient number or charge to provide electronic neutrality.

8. A composition according to claim 2 wherein the $R^1$ through $R^{24}$ units are hydrogen, $C_1$–$C_{22}$ alkoxy, halogen, and mixtures thereof.

9. A composition according to claim 2 wherein the photosensitizing unit is a phthalocyanine and $R^1$ through $R^{16}$ is hydrogen, $C_1$–$C_{22}$ alkoxy, and mixtures thereof, preferably hydrogen or methoxy.

10. A composition according to claim 2 wherein the photosensitizing unit is a naphthalocyanine and $R^1$ through $R^{24}$ is hydrogen, halogen, and mixtures thereof, preferably hydrogen or bromine.

11. A method for photobleaching a stained fabric with a photobleaching composition comprising contacting a stained fabric in need of bleaching with a photobleaching composition according to claim 2 followed by exposing the surface of the treated fabric to a source of light having wavelengths in the range from about 300 to about 1200 nanometers.

12. A method for photodisinfecting a hard surface with a photobleaching composition comprising contacting a hard surface in need of disinfecting with a photobleaching composition according to claim 2 followed by exposing the surface of the treated hard surface to a source of light having wavelengths in the range from about 300 to about 1200 nanometers.

13. The composition of claim 2 wherein the metallocyanine bleach compound is present in an amount of from about 0.01 to about 10,000 ppm.

14. The composition of claim 2 wherein the metallocyanine bleach compound is present in an amount of from about 0.1 to about 5,000 ppm.

15. The composition of claim 2 wherein the metallocyanine bleach compound is present in an amount of from about 10 to about 1,000 ppm.

16. The composition of claim 2 wherein the ClogP value is greater than 2.

17. The composition of claim 2 wherein the ClogP value is greater than 3.

18. The composition of claim 2 wherein the ClogP value is greater than 4.

19. The composition of claim 2 wherein the detersive surfactant is present in an amount of from about 0.1% to about 30% by weight of the composition.

20. The composition of claim 1 wherein the metallocyanine bleach compound is present in an amount of from about 0.01 to about 10,000 ppm.

21. The composition of claim 1 wherein the metallocyanine bleach compound is present in an amount of from about 0.1 to about 5,000 ppm.

22. The composition of claim 1 wherein the metallocyanine bleach compound is present in an amount of from about 10 to about 1,000 ppm.

23. The composition of claim 1 wherein the ClogP value is greater than 2.

24. The composition of claim 1 wherein the ClogP value is greater than 3.

25. The composition of claim 1 wherein the ClogP value is greater than 4.

26. The composition of claim 1 wherein the detersive surfactant is present in an amount of from about 0.1% to about 95% by weight of the composition.

27. The composition of claim 1 wherein the detersive surfactant is present in an amount of from about 0.1% to about 30% by weight of the composition.

28. A method for producing a photobleaching compound effective for cleaning stained fabric having a dingy stain in need of cleaning comprising the steps of a) selecting a photosensitizer unit, said photosensitizer unit selected from the group consisting of substituted or unsubstituted phthalocyanine or naphthalocyanine;

b) reacting the photosensitizer unit with a photoactive metal or non-metal selected from the group consisting of silicon, germanium, tin, lead, aluminum, platinum, palladium, phosphorous, and mixtures thereof to form a metallocyanine unit;

c) selecting a moiety for use as an R axial moiety;

le;2qd) determining the ClogP of the axial moiety conjugate HR form, wherein the ClogP of the HR form must be greater than 1;

e) optionally selecting a T unit; and f) reacting together the metallocyanine unit with the axial R unit and the T unit to form a photobleaching compound having the formula:

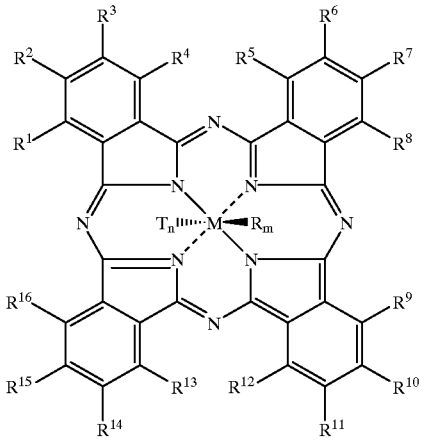

or the formula:

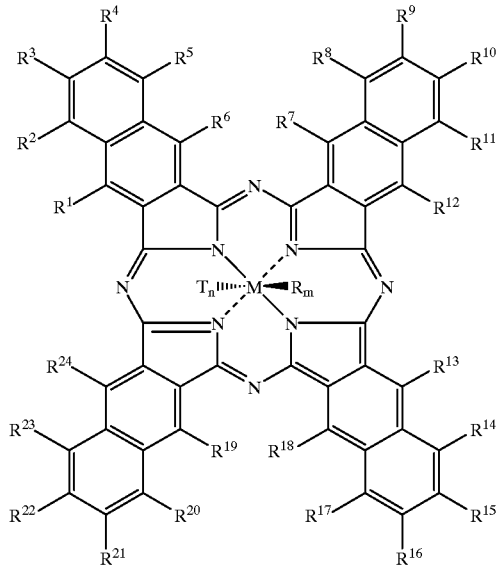

comprising:

a) a photoactive metal or non-metal M, preferably M is selected from the group consisting of silicon, germanium, tin, lead, aluminum, platinum, palladium, phosphorous, and mixtures thereof;

b) a phthalocyanine photosensitizing ring having the formula:

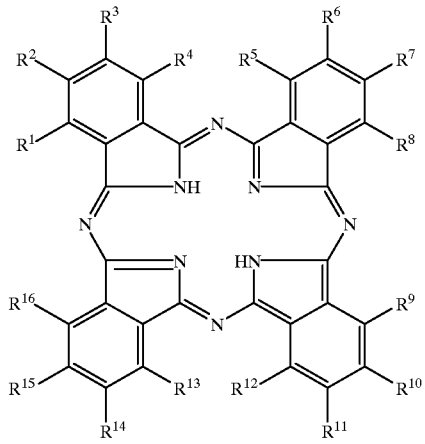

or a naphthalocyanine photosensitizing ring having the formula:

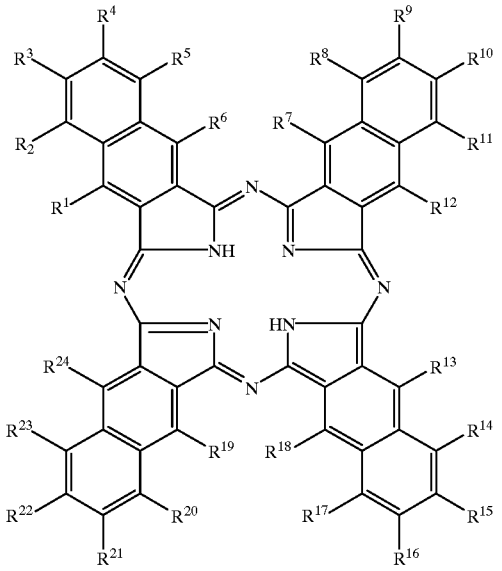

wherein $R^1$ through $R^{24}$ are each independently selected from the group consisting of:

a) hydrogen;

b) halogen;

c) hydroxyl;

d) cyano;

e) nitrilo;

f) oximino;

g) $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

h) halogen substituted $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

i) polyhydroxyl substituted $C_3$–$C_{22}$ alkyl;

j) $C_1$–$C_{22}$ alkoxy;

k) branched alkoxy having the formula

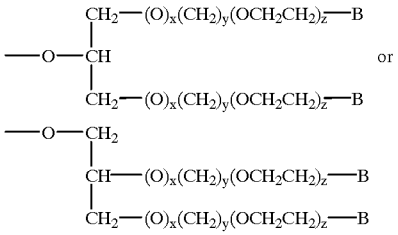

wherein B is hydrogen, hydroxyl, $C_1$–$C_{30}$ alkyl, $C_1$–$C_{30}$ alkoxy, —$CO_2H$, —$CH_2CO_2H$, —$SO_3^-M^+$, —$OSO_3^-M^+$, —$PO_3^{2-}M$, —$OPO_3^{2-}M$, and mixtures thereof; M is a water soluble cation in sufficient amount to satisfy charge balance; x is 0 or 1, each y independently has the value from 0 to 6, each z independently has the value from 0 to 100, l) substituted and unsubstituted aryl;

m) substituted and unsubstituted alkylenearyl;

n) substituted and unsubstituted aryloxy;

o) substituted and unsubstituted oxyalkylenearyl;

p) substituted and unsubstituted alkyleneoxyaryl;

q) $C_1$–$C_{22}$ linear, $C_3$–$C_{22}$ branched thioalkyl, $C_1$–$C_{22}$ linear, $C_3$–$C_{22}$ branched substituted thioalkyl, and mixtures thereof;

r) an ester of the formula —$CO_2R^{25}$ wherein $R^{25}$ comprises i) $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

ii) halogen substituted $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

iii) polyhydroxyl substituted $C_3$–$C_{22}$ alkyl;

iv) $C_3$–$C_{22}$ glycol;

v) $C_1$–$C_{22}$ alkoxy;

vi) $C_3$–$C_{22}$ branched alkoxy;

vii) substituted and unsubstituted aryl;

viii) substituted and unsubstituted alkylaryl;

ix) substituted and unsubstituted aryloxy;

x) substituted and unsubstituted alkoxyaryl;

xi) substituted and unsubstituted alkyleneoxyaryl; or mixtures thereof;

s) an alkyleneamino unit of the formula

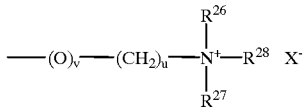

wherein $R^{26}$ and $R^{27}$ comprises $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

$R^{28}$ comprises:

i) hydrogen;

ii) $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

A units comprise nitrogen or oxygen; X comprises chlorine, bromine, iodine, or other water soluble anion, v is 0 or 1, u is from 0 to 22;

t) an amino unit of the formula $$—NR^{29}R^{30}$$

wherein $R^{29}$ and $R^{30}$ comprises $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

u) an alkylethyleneoxy unit of the formula $$—(A)_v—(CH_2)_y(OCH_2CH_2)_xZ$$

wherein Z comprises:

i) hydrogen;

ii) hydroxyl;

iii) —$CO_2H$;

iv) —$SO_3^-M^+$;

v) —$OSO_3^-M^+$;

vi) $C_1$–$C_6$ alkoxy;

vii) substituted and unsubstituted aryl;

viii) substituted and unsubstituted aryloxy;

ix) alkyleneamino; or mixtures thereof;

A units comprise nitrogen or oxygen, M is a water soluble cation, v is 0 or 1,x is from 0 to 100, y is from 0 to 12;

v) substituted siloxy of the formula:

$$—OSiR^{31}R^{32}R^{33}$$

wherein each $R^{31}$, $R^{32}$, and $R^{33}$ is independently selected from the group consisting of:

i) $C_1$–$C_{22}$ alkyl, $C_3$–$C_{22}$ branched alkyl, $C_2$–$C_{22}$ alkenyl, $C_3$–$C_{22}$ branched alkenyl, or mixtures thereof;

ii) substituted and unsubstituted aryl;
iii) substituted and unsubstituted aryloxy;
iv) an alkylethyleneoxy unit of the formula $$—(A)_v—(CH_2)_y(OCH_2CH_2)_xZ;$$

wherein Z comprises:
a) hydrogen;
b) $C_1$–$C_{30}$ alkyl,
c) hydroxyl;
d) $—CO_2H$;
e) $—SO_3^-M^+$;
f) $—OSO_3^-M^+$;
g) $C_1$–$C_6$ alkoxy;
h) substituted and unsubstituted aryl;
i) substituted and unsubstituted aryloxy;
j) alkyleneamino; or mixtures thereof;
A units comprise nitrogen or oxygen, M is a water soluble cation, v is 0 or 1, x is from 0 to 100, y is from 0 to 12; and mixtures thereof;

c) R units wherein the R units are axial, said R units are a hydrophobic moiety that when in the conjugate HR form have an octanol/water ClogP of greater than 1; m has the value 1 or 2;

d) T units wherein the T units are axial, said T units are anionic moieties; n has the value 0 or 1; provided that when n is equal to 1 then m is equal to 1, and when m is equal to 2 then n is equal to 0.

* * * * *